US009976552B2

(12) United States Patent
Yagi et al.

(10) Patent No.: US 9,976,552 B2
(45) Date of Patent: May 22, 2018

(54) PERFORMANCE PREDICTION DEVICE AND PERFORMANCE PREDICTION METHOD FOR COMPRESSOR

(71) Applicant: HITACHI, LTD., Tokyo (JP)

(72) Inventors: Manabu Yagi, Tokyo (JP); Hideo Nishida, Ibaraki (JP); Haruo Miura, Tokyo (JP); Kazutoshi Yanagihara, Tokyo (JP)

(73) Assignee: HITACHI, LTD., Tokyo (JP)

( * ) Notice: Subject to any disclaimer, the term of this patent is extended or adjusted under 35 U.S.C. 154(b) by 58 days.

(21) Appl. No.: 15/134,800

(22) Filed: Apr. 21, 2016

(65) Prior Publication Data

US 2016/0312776 A1 Oct. 27, 2016

(30) Foreign Application Priority Data

Apr. 23, 2015 (JP) ..... 2015-088149

(51) Int. Cl.

*F04B 51/00* (2006.01)
*F04D 15/00* (2006.01)
*F04D 27/00* (2006.01)

(52) U.S. Cl.

CPC ..... *F04B 51/00* (2013.01); *F04D 15/0044* (2013.01); *F04D 27/001* (2013.01); *F05D 2260/821* (2013.01)

(58) Field of Classification Search

None

See application file for complete search history.

(56) References Cited

U.S. PATENT DOCUMENTS 8,756,938 B2 * 6/2014 Sasahara ..... F02C 6/18 60/39.091
2012/0160021 A1 * 6/2012 Iannuzzi ..... F02C 3/22 73/112.05

FOREIGN PATENT DOCUMENTS

EP 2 469 242 A2 6/2012
JP 2012-137087 A 7/2012

OTHER PUBLICATIONS

Marcelo Accorsi Miranda et al, "ASME PTC 10 Modified Test for Mechanical Assessment of Centrifugal Compressors," Proceedings of the Turbomachinery Symposium; Jan. 1, 2007; pp. 87-94.
Sep. 15, 2016 Extended Search Report issued in European Patent Application No. 16166680.5.

* cited by examiner

*Primary Examiner* — Andre Allen
(74) *Attorney, Agent, or Firm* — Oliff PLC

(57) ABSTRACT

A performance prediction device includes: an actual measured data obtaining unit that obtains actual measured data of a compressor; a test gas physical property correction formula database in which test gas physical property correction formulae are stored; a test parameter calculation unit that calculates test parameters of the compressor; and a test parameter correction unit that selects at least one of the test gas physical property correction formulae from the test gas physical property correction formula database based on types and a mix ratio of gases included in a test gas to be used in the prediction and corrects the test parameters by using the selected test gas physical property correction formula.

10 Claims, 10 Drawing Sheets

FIG.4

| TYPE OF TEST GAS | GAS $G1_t$ (mol%) | GAS $G2_t$ (mol%) | MOLECULAR WEIGHT | CORRECTION FORMULA OF COMPRESSIBILITY FACTOR | CORRECTION FORMULA OF SPECIFIC HEAT AT CONSTANT VOLUME |
|---|---|---|---|---|---|
| $Mix1_t$ | 100 | 0 | $Mw_Mix1_t = Mw_G1_t$ | $Az1_t \times Z_t + Bz1_t$ | $Acv1_t \times Cv_t + Bcv1_t$ |
| $Mix2_t$ | 80 | 20 | $Mw_Mix2_t = Mw_G1_t \times 80/100 + Mw_G2_t \times 20/100$ | $Az2_t \times Z_t + Bz2_t$ | $Acv2_t \times Cv_t + Bcv2_t$ |
| $Mix3_t$ | 50 | 50 | $Mw_Mix3_t = Mw_G1_t \times 50/100 + Mw_G2_t \times 50/100$ | $Az3_t \times Z_t + Bz3_t$ | $Acv3_t \times Cv_t + Bcv3_t$ |
| $Mix4_t$ | 20 | 80 | $Mw_Mix4_t = Mw_G1_t \times 20/100 + Mw_G2_t \times 80/100$ | $Az4_t \times Z_t + Bz4_t$ | $Acv4_t \times Cv_t + Bcv4_t$ |
| $Mix5_t$ | 0 | 100 | $Mw_Mix5_t = Mw_G2_t$ | $Az5_t \times Z_t + Bz5_t$ | $Acv5_t \times Cv_t + Bcv5_t$ |

FIG.7

| TYPE OF ON-SITE GAS | GAS $Ga_{sp}$ (mol%) | GAS $Gb_{sp}$ (mol%) | MOLECULAR WEIGHT | CORRECTION FORMULA OF COMPRESSIBILITY FACTOR | CORRECTION FORMULA OF SPECIFIC HEAT AT CONSTANT VOLUME |
|---|---|---|---|---|---|
| $Mix1_{sp}$ | 100 | 0 | $Mw_Mix1_sp = Mw_Ga_{sp}$ | $Az1_{sp} \times Z_{sp} + Bz1_{sp}$ | $Acv1_{sp} \times Cv_{sp} + Bcv1_{sp}$ |
| $Mix2_{sp}$ | 80 | 20 | $Mw_Mix2_sp = Mw_Ga_{sp} \times 80/100 + Mw_Gb_{sp} \times 20/100$ | $Az2_{sp} \times Z_{sp} + Bz2_{sp}$ | $Acv2_{sp} \times Cv_{sp} + Bcv2_{sp}$ |
| $Mix3_{sp}$ | 50 | 50 | $Mw_Mix3_sp = Mw_Ga_{sp} \times 50/100 + Mw_Gb_{sp} \times 50/100$ | $Az3_{sp} \times Z_{sp} + Bz3_{sp}$ | $Acv3_{sp} \times Cv_{sp} + Bcv3_{sp}$ |
| $Mix4_{sp}$ | 20 | 80 | $Mw_Mix4_sp = Mw_Ga_{sp} \times 20/100 + Mw_Gb_{sp} \times 80/100$ | $Az4_{sp} \times Z_{sp} + Bz4_{sp}$ | $Acv4_{sp} \times Cv_{sp} + Bcv4_{sp}$ |
| $Mix5_{sp}$ | 0 | 100 | $Mw_Mix5_sp = Mw_Gb_{sp}$ | $Az5_{sp} \times Z_{sp} + Bz5_{sp}$ | $Acv5_{sp} \times Cv_{sp} + Bcv5_{sp}$ |

PERFORMANCE PREDICTION DEVICE AND PERFORMANCE PREDICTION METHOD FOR COMPRESSOR

BACKGROUND OF THE INVENTION

1. Field of the Invention

The present invention relates to a performance prediction device and a performance prediction method for a compressor.

2. Description of the Related Art

Compressors are widely used in chemical plants and machines. Before a compressor is provided to a user, a similitude test complying with, for example, the performance test code 10 (PTC 10) of American Society of Mechanical Engineers (ASME) is performed and the compressor is tested to determine whether it satisfies requirements specified by the user such as performance to be fulfilled. The "similitude test" described above is a test in which the compressor actually operates in a test facility and is checked as to whether the compressor achieves the efficiency and the like within ranges to be fulfilled. Techniques relating to such a similitude test include, for example, the technique described below.

Japanese Patent Application Publication No. 2012-137087 describes a similitude test of a compressor which is performed by using a "test gas having a molecular weight between 40 g/gmol and 150 g/gmol, a global warming potential (GWP) of less than 700, and a gas specific heat ratio of between 1 and 1.5." Note that the "test gas" is a gas used in the similitude test of the compressor.

SUMMARY OF THE INVENTION

In the similitude test system described in Japanese Patent Application Publication No. 2012-137087, the compressor operates by using a test gas selected by a compressor manufacturer based on PTC 10 in place of an on-site gas composition specified by the user for a gas to be used when the compressor operates on an actual site (for example, in a chemical plant), and test parameters are calculated based on the temperatures and pressures of the compressor on the intake side and the discharge side. Then, the similitude test system compares the aforementioned test parameters and their corresponding specification parameters to determine whether the compressor passes the similitude test.

In the similitude test of the compressor, physical properties (for example, a compressibility factor) of the test gas are often calculated by using existing calculating means. However, there are many types of test gases used in the similitude test and test gases obtained by mixing multiple types of gases are used in some cases. Accordingly, the test gas physical properties calculated by using the existing calculating means do not always preferably match actual measured values under conditions of the intake temperature, the intake pressure, the discharge temperature, and the discharge pressure in the similitude test.

If an error between a calculated value and an actual measured value of the test gas physical property is great, there may be a case where a favorable matching is failed between the actual value and the calculated value of the test parameter for use to determine whether the compressor passes the similitude test, and the compressor cannot achieve performance to be fulfilled when being installed and operating on the site.

In view of this, an object of the present invention is to provide a performance prediction device and the like which can appropriately predict performance of a compressor.

In order to solve the problems described above, the present invention includes: an actual measured data obtaining unit that obtains actual measured data of a flow rate, an intake temperature, an intake pressure, a discharge temperature, and a discharge pressure of a compressor being a test target of a similitude test while the compressor is compressing a test gas including a plurality of types of gases; a test gas physical property correction formula database that stores therein test gas physical property correction formulae each indicating a relationship of test gas physical properties, including a compressibility factor and a specific heat at constant volume, of the test gas actually used in the similitude test, with the test gas physical properties of a plurality of the test gases different in mix ratio of the gases, the test gas physical property correction formulae each being associated with the types and the mix ratios of the gases; a test parameter calculation unit that calculates test parameters based on the actual measured data obtained by the actual measured data obtaining unit, the test parameters including a polytropic head and a polytropic efficiency which indicate performance of the compressor; and a test parameter correction unit that selects at least one of the test gas physical property correction formulae from the test gas physical property correction formula database based on the types and the mix ratio of the gases included in the test gas used in prediction of the performance of the compressor, and that corrects the test parameters by using the selected test gas physical property correction formula.

The present invention can provide a performance prediction device and the like which can appropriately predict the performance of a compressor.

BRIEF DESCRIPTION OF THE DRAWINGS

FIG. 4 is an explanatory view depicting information stored in a test gas physical property correction formula database.

FIG. 7 is an explanatory diagram illustrating information stored in an on-site gas physical property correction formula database.

DETAILED DESCRIPTION OF THE EMBODIMENTS

Embodiments of the present invention will be hereinafter described in detail with reference to the accompanying drawings.

First Embodiment

A test facility 1 (see FIG. 1) for performing a similitude test of a compressor 2 (see FIG. 1) is described below. Then, a performance prediction device 3 (see FIG. 2) in the embodiment is described in detail.

<Configuration of Test Facility>

Figure 1:
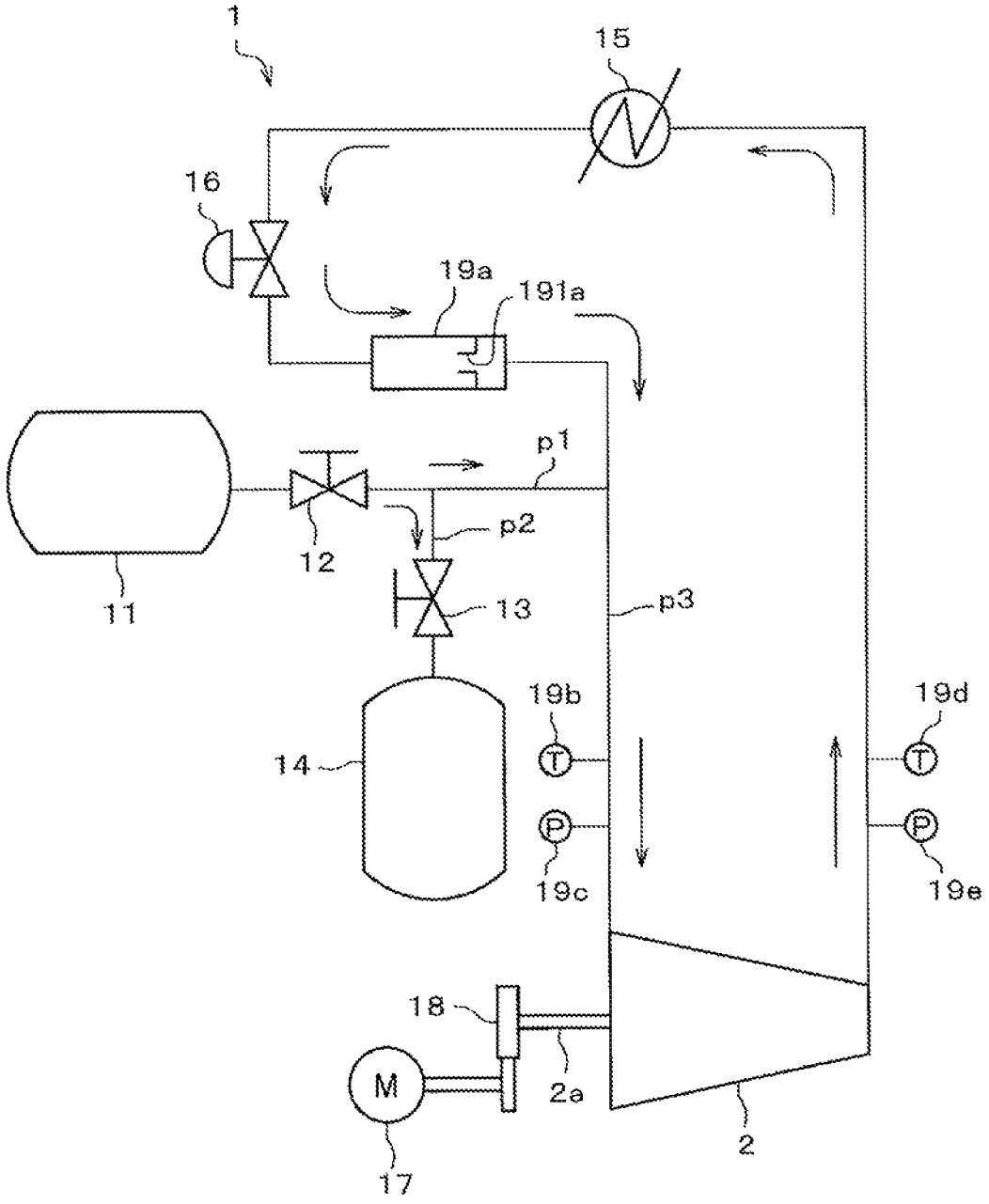
FIG. 1 is a configuration diagram of a test facility for a compressor whose performance is predicted by a performance prediction device in a first embodiment of the present invention.

FIG. 1 is a configuration diagram of the test facility 1 for the compressor 2 whose performance is predicted by the performance prediction device 3 (see FIG. 2) in a first embodiment.

The compressor 2 is, for example, a single-shaft multi-stage centrifugal compressor and includes a drive shaft 2*a* illustrated in FIG. 1, a rotor (not illustrated) configured to rotate integrally with the drive shaft 2*a*, rotor blades (not illustrated) fixed to the rotor, and a casing (not illustrated) housing the rotor and the rotor blades. The compressor 2 gives energy to a test gas by using the rotor blades to increase a pressure of the test gas in a process where the test gas flows between the casing and the rotating rotor blades.

In this description, the "test gas" is a gas used in the similitude test of the compressor 2. The "test gas" includes a gas actually compressed by the compressor 2 in the similitude test as well as gases assumed to be compressed by the compressor 2 in later-described performance calculation of the compressor 2 performed by the performance prediction device 3 (see FIG. 2).

Moreover, the "similitude test" is a test performed before the compressor 2 is actually used on a site (for example, in a chemical plant) to check whether the compressor 2 has satisfactory performance specified by a user.

On the site where the compressor 2 is actually used, a gas compressed by the compressor 2 is supplied to a device (not illustrated) downstream of the compressor 2. However, in the test facility 1 for the similitude test, the compressor 2 is installed such that the compressed gas returns to an intake side of the compressor 2.

The test facility 1 illustrated in FIG. 1 is a facility in which the pressure, temperature, and the like of the test gas are detected at least on the intake side and the discharge side of the compressor 2 with the compressor 2 actually operating by using the test gas and the performance prediction device 3 (see FIG. 2) to be described later predicts the performance of the compressor 2 under an on-site operating condition. The "on-site operating condition" is an operating condition such as temperature, pressure, and a flow rate at an intake position of the compressor 2 and a rotating speed of the compressor 2 in a situation where the compressor 2 is actually used on the site (for example, in a chemical plant).

The test facility 1 includes a gas supply source 11, a gas supply valve 12, a gas purge valve 13, a gas reserve container 14, a heat exchanger 15, an intake throttle valve 16, a motor 17, a transmission 18, a flow rate sensor 19*a*, an intake temperature sensor 19*b*, an intake pressure sensor 19*c*, a discharge temperature sensor 19*d*, and a discharge pressure sensor 19*e*. As illustrated in FIG. 1, the compressor 2, the heat exchanger 15, the intake throttle valve 16, and the flow rate sensor 19*a* are annularly connected to one another in this order.

The gas supply source 11 is a supply source of the test gas used in the similitude test, and is connected to the intake side of the compressor 2 via a pipe p1 and (part of) a pipe p3. For example, one of nitrogen, carbon dioxide, helium, Freon, methane, ethane, and propane can be used as the test gas, or multiple gases out of the gases described above can be mixed at a certain ratio and used as the test gas. The gas supply valve 12 is a valve for switching between supply and shut-off of the gas from the gas supply source 11, and is installed in the pipe p1.

The gas purge valve 13 is a valve which controls the concentration of the test gas compressed in the compressor 2, and is installed in a pipe p2. The gas reserve container 14 is a container configured to store a divided gas which flows into the gas reserve container 14 via (part of) the pipe p1 and the pipe p2 when the gas purge valve 13 is opened.

The heat exchanger 15 cools a high-temperature gas discharged from the compressor 2 by means of heat exchange with coolant such as cooling water. The intake throttle valve 16 is a valve which controls the flow rate of the gas flowing toward the intake side of the compressor 2. The motor 17 is a power source which provides shaft power to the compressor 2. The transmission 18 transmits the power of the motor 17 to the drive shaft 2*a* at a predetermined gear ratio.

The flow rate sensor 19*a* is a sensor which measures the flow rate of the gas based on a differential pressure of the gas in a nozzle 191*a*.

The intake temperature sensor 19*b* is a sensor which detects an intake temperature of the compressor 2. The intake pressure sensor 19*c* is a sensor which detects an intake pressure of the compressor 2. The intake temperature sensor 19*b* and the intake pressure sensor 19*c* are installed near an intake port of the compressor 2.

The discharge temperature sensor 19*d* is a sensor which detects a discharge temperature of the compressor 2. The discharge pressure sensor 19*e* is a sensor which detects a discharge pressure of the compressor 2. The discharge temperature sensor 19*d* and the discharge pressure sensor 19*e* are installed near a discharge port of the compressor 2.

Detection values of the flow rate sensor 19*a*, the intake temperature sensor 19*b*, the intake pressure sensor 19*c*, the discharge temperature sensor 19*d*, and the discharge pressure sensor 19*e* are outputted to the performance prediction device 3 (see FIG. 2) to be described next.

<Configuration of Performance Prediction Device>

Figure 2:
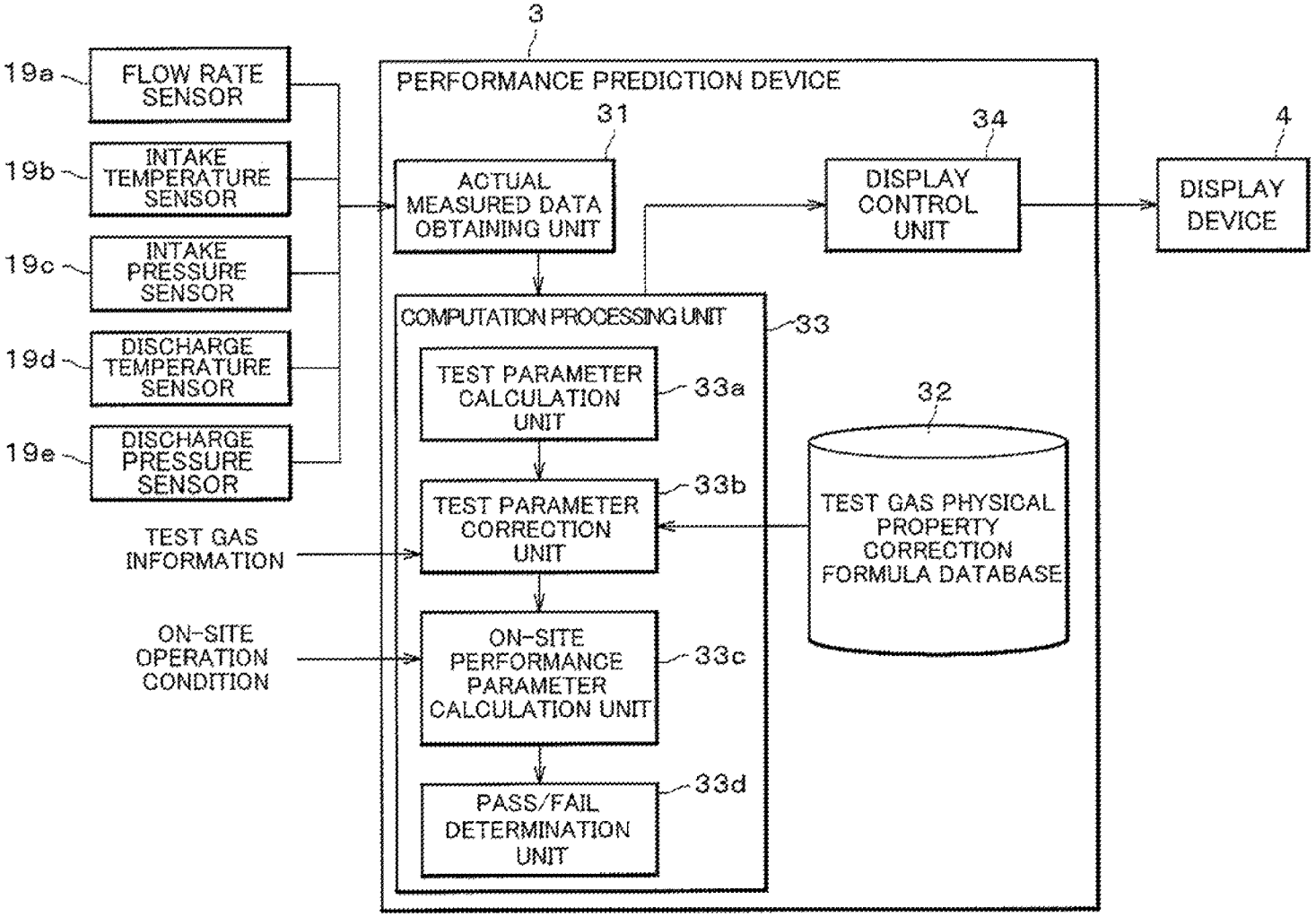
FIG. 2 is a functional block diagram of the performance prediction device for the compressor.

FIG. 2 is a functional block diagram of the performance prediction device 3 for the compressor 2.

The performance prediction device 3 is a device which predicts the performance of the compressor 2 by performing performance calculation using the detection values of the sensors 19*a* to 19*e* as input values. Although not illustrated, the performance prediction device 3 includes electronic circuits such as a central processing unit (CPU), a read-only memory (ROM), a random access memory (RAM), and various interfaces. The performance prediction device 3 is configured such that a program stored in the ROM is developed on the RAM and the CPU executes processing.

As illustrated in FIG. 2, the performance prediction device 3 includes actual measured data obtaining unit 31, a test gas physical property correction formula database 32, computation processing unit 33, and display control unit 34.

The actual measured data obtaining unit 31 has a function of obtaining the detection values (actual measured data) of the flow rate sensor 19*a*, the intake temperature sensor 19*b*, the intake pressure sensor 19*c*, the discharge temperature sensor 19*d*, and the discharge pressure sensor 19*e*, for example, at predetermined intervals. Specifically, during the operation of the compressor 2 (see FIG. 1) which is the test target of the similitude test, the actual measured data obtaining unit 31 obtains the actual measured data of the compressor 2 compressing the test gas.

The test gas physical property correction formula database 32 stores test gas physical property correction formulae for test gas physical properties (a compressibility factor and a specific heat at constant volume) of a test gas which is actually used in the similitude test and for test gas physical properties of multiple test gases which are not actually used in the similitude test and which are different in a mix ratio of gases. Each of the test gas physical property correction formulae indicates a relationship between an actual measured value and a calculated value of a corresponding one of the gas physical properties of the test gases, the actual measured value obtained by gas physical property measurement experiment performed separately in advance, the calculated value obtained by known calculating means for calculating the gas physical property from a gas mix ratio and the like.

For example, a customer using the compressor 2 often requests to know the performance of the compressor 2 in a situation where a test gas including two types of gases G1$_t$ and G2$_t$ at a certain mix ratio is used. Note that, even if there is no difference in the configuration of the compressor 2, values of the compressibility factor and the specific heat at constant volume of the test gas vary when the composition of the test gas varies (types and a mix ratio of gases included in the test gas vary), and values of efficiency and the like of the compressor 2 resultantly vary.

Every time a customer specifies a test gas, it is conceivable to produce the specified test gas and perform the similitude test of the compressor 2. However, this requires long time and high cost. In view of this, in the embodiment, a method is employed in which combinations of gases (for example, gases G1$_t$ and G2$_t$) which are likely to be specified by the customer in the future are assumed and the test gas physical property correction formulae for these combinations are stored as a database while being associated with the types, mix ratios, and molecular weights of the gases. Note that the subscript "t" of the gases G1$_t$ and G2$_t$ indicates that the gases are related to the similitude test of the compressor 2 (and are not related to an on-site specification).

Information stored in the test gas physical property correction formula database 32 is described below by giving examples of test gases obtained by mixing two types of gases G1$_t$ and G2$_t$ (including a case where one of the gases is 0% and the other one is 100%).

Figure 3A:
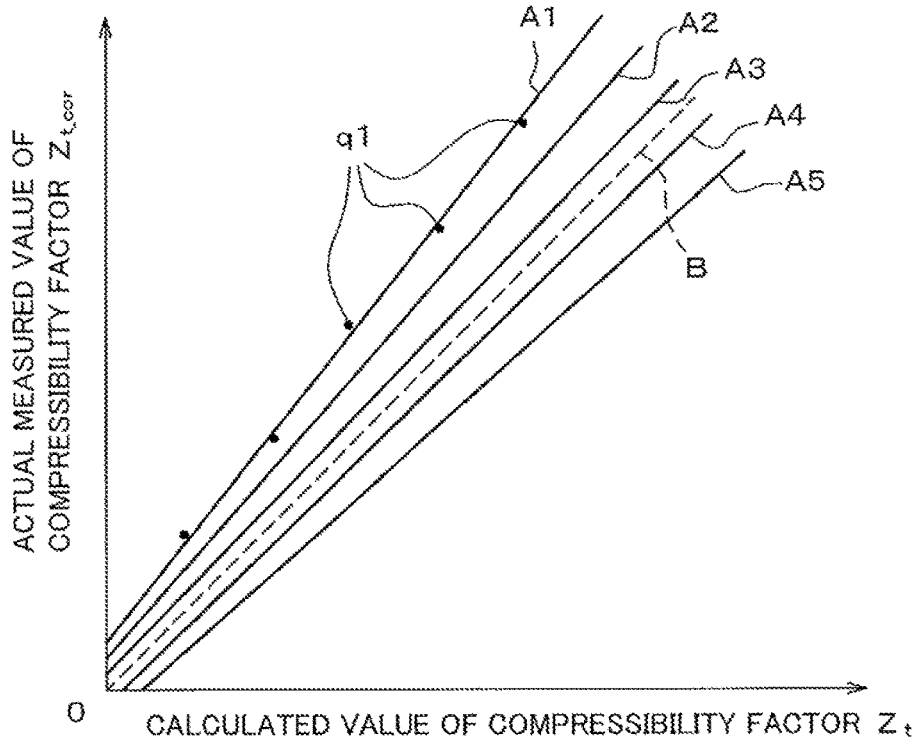
FIG. 3A is an explanatory view depicting relationships between a calculated value of compressibility factor $Z_t$ in the similitude test and an actual measured value of compressibility factor $Z_{t_cor}$ in the similitude test.

FIG. 3A is an explanatory view depicting a relationship between a calculated value of compressibility factor $Z_t$ in the similitude test and an actual measured value of compressibility factor $Z_t$ in the similitude test. The vertical axis of FIG. 3A represents the actual measured value of compressibility factor $Z_{t_cor}$ calculated from following (formula 1) by using an actual measured value of a density $\rho_{t_cor}$ of a test gas obtained by mixing the two types of gases G1$_t$ and G2$_t$ at a certain ratio, the density $\rho_{t_cor}$ measured by pumping the test gas into a chamber (not illustrated) with a temperature $T_{t_cor}$ and a pressure $\rho_{t_cor}$ of the test gas being varied in a gas physical property measurement test device (not illustrated) which is used separately and prior to the test facility 1 (see FIG. 1). Note that $R_t$ [J/kg·K] shown in (formula 1) is a gas constant of the test gas.

[Math 1]

$$Z_{t_cor} = \frac{P_{t_cor}}{\rho_{t_cor} R_t T_{t_cor}} \quad \text{(formula 1)}$$

For example, assume that five points q1 depicted in FIG. 3A are actually measured for the compressibility factor $Z_{t_cor}$ by pumping a test gas Mix1$_t$ (gas G1$_t$: 100%, gas G2$_t$: 0%) into the chamber with the temperature $T_{t_cor}$ and the pressure $P_{t_cor}$ of the test gas Mix1$_t$ being varied in the gas physical property measurement test device (not illustrated) which is used separately and prior to the test facility 1. Note that the subscript "cor" of $Z_{t_cor}$ means "actual measured value used for correction."

Thereafter, temperatures, pressures, and the like of a test gas (for example, gas G1$_t$: 30%, gas G2$_t$: 70%) actually used in the similitude test which correspond to the detection values of the sensors 19*b* to 19*e* (see FIG. 1) are inputted into the performance prediction device 3. Furthermore, the compressibility factor $Z_t$ [−] of this test gas is calculated based on following (formula 2) according to the temperatures and pressures actually measured in the similitude test of the compressor 2. The calculated value of compressibility factor $Z_t$ is the horizontal axis of FIG. 3A.

Note that $P_t$ shown in (formula 2) is the pressure of the test gas detected by the sensors 19*c* and 19*e* (see FIG. 1) during the similitude test and $T_t$ [K] is the temperature of the test gas detected by the sensors 19*b* and 19*d* (see FIG. 1) during the similitude test. Here, description is given of an example in which an average value of different pressures detected by the sensors 19*c* and 19*e* is used as $P_t$ and an average value of different temperatures detected by the sensors 19*b* and 19*d* is used as $T_t$. Note that $\rho_t$ [kg/m$^3$] shown in (formula 2) is a density calculated by known calculating means for the test gas and $R_t$ [J/kg·K] is the gas constant of the test gas.

[Math 2]

$$Z_t = \frac{P_t}{\rho_t R_t T_t} \quad \text{(formula 2)}$$

The performance prediction device 3 performs linear approximation of the five points q1 based on, for example, the least squares method, and holds a function expressing the straight line A1 depicted in FIG. 3A. Similarly, the performance prediction device 3 holds the correction formula of the compressibility factor for each of a test gas MIX2$_t$ (gas G1$_t$: 80%, gas G2$_t$: 20%), a test gas MIX3$_t$ (gas G1$_t$: 50%, gas G2$_t$: 50%), a test gas MIX4$_t$ (gas G1$_t$: 20%, gas G2$_t$: 80%), and a test gas MIX5$_t$ (gas G1$_t$: 0%, gas G2$_t$: 100%). In other words, the performance prediction device 3 holds functions expressing the straight lines A2 to A5 depicted in FIG. 3A. These pieces of information are stored in the test gas physical property correction formula database 32 (see FIG. 2).

Note that when a straight line whose slope is 1 and whose intercept is 0 is obtained in the linear approximation, the compressibility factor $Z_t$ (calculated value) is equal to the compressibility factor $Z_{t_cor}$ (actual measured value) (see the broken line: straight line B in FIG. 3A).

Figure 3B:
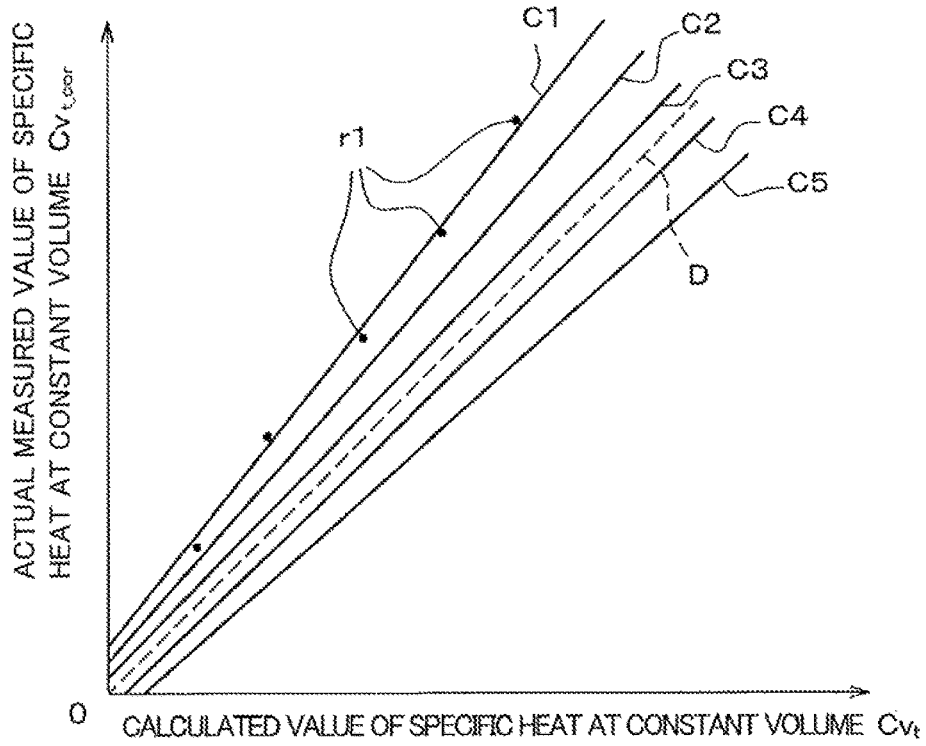
FIG. 3B is an explanatory view depicting relationships between a calculated value of specific heat at constant volume $Cv_t$ in the similitude test and an actual measured value of specific heat at constant volume $C_{Vt_cor}$ in the similitude test.

FIG. 3B is an explanatory view depicting a relationship between a calculated value of specific heat at constant volume $Cv_t$ in the similitude test and an actual measured value of specific heat at constant volume $Cv_t$ in the similitude test. The vertical axis of FIG. 3B represents a specific heat at constant volume $Cv_{t_cor}$ (actual measured value) of each of the test gases $MIX1_t$ to $MIX5_t$ described above which is obtained with the temperature and pressure in the chamber (not illustrated) being varied in the gas physical property measurement test device (not illustrated) which is used separately and prior to the test facility 1. Assume that five points r1 depicted in FIG. 3B are detected for the specific heat at constant volume $Cv_{t_cor}$ by varying the temperature and pressure in the chamber.

The horizontal axis of FIG. 3B represents the specific heat at constant volume $Cv_t$ (calculated value) of the test gas actually used in the similitude test which is calculated by a well-known method, based on the temperature, the pressure, and the like corresponding to each of the five points r1.

The performance prediction device 3 performs linear approximation of the five points r1 based on, for example, the least squares method, and holds a function expressing the straight line C1 depicted in FIG. 3B. Similarly, the performance prediction device 3 holds a function for deriving the specific heat at constant volume $Cv_{t_cor}$ (actual measured value) of each of the test gases $MIX2_t$ to $MIX5_t$ described above, from the specific heat at constant volume $Cv_t$ (calculated value) of the test gas actually used in the similitude test. In other words, the performance prediction device 3 holds functions expressing the straight lines C2 to C5 depicted in FIG. 3B. These pieces of information are stored in advance in the test gas physical property correction formula database 32 (see FIG. 2) prior to the similitude test of the compressor 2.

Note that when a straight line whose slope is 1 and whose intercept is 0 is obtained in the linear approximation, the specific heat at constant volume $Cv_t$ (calculated value) is equal to the specific heat at constant volume $Cv_{t_cor}$ (actual measured value) (see the broken line: straight line D in FIG. 3B).

FIG. 4 is an explanatory view depicting the information stored in the test gas physical property correction formula database 32. As depicted in FIG. 4, the correction formulae of the compressibility factor for the test gases $MIX1_t$ to $MIX5_t$ and the correction formulae of the specific heat at constant volume for the test gases $MIX1_t$ to $miX5_t$ are stored in the test gas physical property correction formula database 32 (see FIG. 2) while being associated with the types and mix ratios (mole fractions) of the gases $G1_t$ and $G2_t$ and the molecular weights of the test gases.

For example, the correction formula of the compressibility factor of the test gas $MIX1_t$ with the mix ratio of gas $G1_t$: 100%, gas $G2_t$: 0% depicted in FIG. 4 is a function; $Z_{t_cor}=Az1_t \times Z_t+Bz1_t$ and corresponds to the straight line A1 depicted in FIG. 3A.

Meanwhile, for example, the correction formula of the specific heat at constant volume of the test gas $MIX3_t$ with the mix ratio of gas $G1_t$: 50%, gas $G2_t$: 50% depicted in FIG. 4 is a function: $Cv_{t_cor}=Acv3_t \times Cv_t+Bcv3_t$ and corresponds to the straight line C3 depicted in FIG. 3B.

For example, as the molecular weight of the test gas presented in FIG. 4 decreases (for example, $Mw_{_Mix1_t} > Mw_{_Mix2_t} > \ldots > Mw_{_Mix5_t}$), the slope and intercept of the straight line for the test gas become smaller as depicted by decrease in the slope and intercept from the straight line A1 to the straight line A5 in FIG. 3A. Specifically, when the molecular weight of the test gas continuously changes, the slope and intercept of the straight line giving the relationship between the compressibility factors $Z_t$, $Z_{t_cor}$ also continuously change with the change of the molecular weight. As described above, when there is no difference in gas composition components of the test gas, the slope and intercept continuously change relative to the change of the molecular weight. Accordingly, even when a gas with a mix ratio for which gas physical properties are not actually measured in the creation of the database is used as the test gas, the slope and intercept of a straight line which gives the relationship between the compressibility factors $Z_t$, $Z_{t_cor}$ can be derived by performing linear interpolation based on the molecular weight of the test gas as will be described later.

Note that the same applies to the specific heat at constant volume (see FIG. 3B).

When gases included in the test gas are different in types from those described above (for example, when the test gas is obtained by mixing not-illustrated gases $G3_t$ and $G4_t$), pieces of information on such a test gas are stored in another storage region of the test gas physical property correction formula database 32.

Returning to FIG. 2, let us continue the description. The computation processing unit 33 performs computation processing relating to performance parameters indicating the performance of the compressor 2 (see FIG. 1), and includes a test parameter calculation unit 33*a*, a test parameter correction unit 33*b*, an on-site performance parameter calculation unit 33*c*, and a pass/fail determination unit 33*d*.

The test parameter calculation unit 33*a* has a function of calculating test parameters of the compressor 2 based on the actual measured data obtained by the actual measured data obtaining unit 31. In this description, the "test parameters" are state quantities to be evaluation criteria of the performance of the compressor 2 and, in the embodiment, refer to a polytropic head and a polytropic efficiency of the compressor 2 in the similitude test.

The "polytropic head" described above is a pressure head approximately obtained by assuming well-known polytropic compression instead of areal compression process in the compressor 2. Moreover, the "polytropic efficiency" refers to a proportion of actually-required specific work to effective work based on the assumption of the polytropic compression.

The test parameter correction unit 33*b* has a function of correcting the test parameters of the compressor 2 based on the types and the mix ratio of the gases $G1_t$ and $G2_t$ included in the test gas specified by the customer or the like ("test gas information" depicted in FIG. 2) and the information stored in the test gas physical property correction formula database 32.

The on-site performance parameter calculation unit 33*c* has a function of calculating on-site performance parameters of the compressor 2 based on the test parameters calculated by the test parameter calculation unit 33*a* and an on-site operation condition at which to operate the compressor 2 on the site different from the test facility 1 of the similitude test. In this description, the "on-site performance parameters" are state quantities to be evaluation criteria of the performance of the compressor 2 and, in the embodiment, refer to a discharge pressure of the compressor 2 on the site and power required for the operation of the compressor 2.

The pass/fail determination unit 33*d* has a function of determining whether the compressor 2 satisfies predetermined requirements relating to the performance, based on the test parameters corrected by the test parameter correction unit 33*b* and the on-site performance parameters calculated by the on-site performance parameter calculation unit 33*c*.

The processing of the test parameter calculation unit 33*a*, the test parameter correction unit 33*b*, the on-site performance parameter calculation unit 33*c*, and the pass/fail determination unit 33*d* is described later.

The display control unit 34 has a function of displaying processing results of the computation processing unit 33 as images on a display device 4 (for example, a display).

<Operations of Performance Prediction Device)

Figure 5:
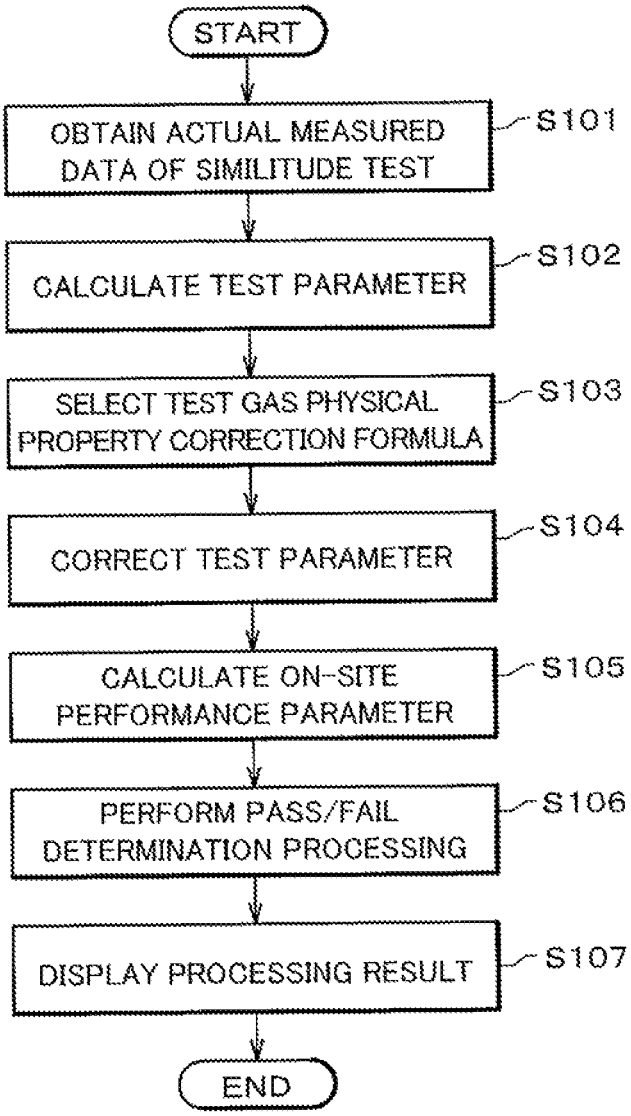
FIG. 5 is a flowchart illustrating processing executed by the performance prediction device.

FIG. 5 is a flowchart illustrating processing executed by the performance prediction device 3.

In step S101, in the performance prediction device 3, the actual measured data obtaining unit 31 obtains the actual measured data from the sensors 19*a* to 19*e* when the compressor 2 is actually operating in the test facility 1 (actual measured data obtaining step).

In step S102, in the performance prediction device 3, the test parameter calculation unit 33*a* calculates the test parameters of the compressor 2, based on the actual measured data obtained in step S101 (test parameter calculating step).

First, the performance prediction device 3 calculates the polytropic head $H_{pol_t}$ [J/kg] of the compressor 2 in the similitude test by using following (formula 3). Note that $n_t$ [−] shown in (formula 3) is a polytropic exponent of the compressor 2 in the similitude test, and $f_t$ [−] is a polytropic factor of the compressor 2 in the similitude test.

Moreover, $P_{d_t}$ [Pa] is the discharge pressure detected by the discharge pressure sensor 19*e* (see FIG. 1), and $P_{i_t}$ [Pa] is the intake pressure detected by the intake pressure sensor 19*c*. $v_{d_t}$ [$m^3$/kg] is a discharge gas specific volume, and $v_{i_t}$ [$m^3$/kg] is an intake gas specific volume. The discharge gas specific volume $v_{d_t}$ and the intake gas specific volume $v_{i_t}$ are calculated by a well-known method by using gas physical property calculation software or the like, based on the detection values of the sensors 19*a* to 19*e* (see FIG. 1).

[Math 3]

$$H_{pol_t} = \frac{n_t}{n_t - 1} f_t \times (P_{d_t} v_{d_t} - P_{i_t} v_{i_t}) \quad \text{(formula 3)}$$

The polytropic exponent $n_t$ shown in (formula 3) is calculated based on following (formula 4).

[Math 4]

$$n_t = \frac{\ln \frac{P_{d_t}}{P_{i_t}}}{\ln \frac{v_{i_t}}{v_{d_t}}} \quad \text{(formula 4)}$$

Moreover, the polytropic factor $f_t$ shown in (formula 3) is calculated based on following (formula 5). Note that $h_{d_t}'$ [J/kg] shown in (formula 5) is an enthalpy of the discharge gas in the case where isenthalpic change is assumed to occur in the compressor 2, and $h_{i_t}$ [J/kg] is an enthalpy of the intake gas. $v_{d_t}'$ [$m^3$/kg] is the discharge gas specific volume in the case where isenthalpic change is assumed to occur.

[Math 5]

$$f_i = \frac{(h_{d_t}' - h_{i_t})}{\frac{n_t}{n_t - 1} \times (P_{d_t} v_{d_t}' - P_{i_t} v_{i_t})} \quad \text{(formula 5)}$$

As described above, in the prediction of the performance of the compressor 2, there is a case where the test gas (for example, gas G1$_t$: 30%, gas G2$_t$: 70%) actually used in the similitude test is different from a test gas to be used in the prediction (for example, test gas Mix3 depicted in FIG. 4), i.e. the test gases are different in gas physical properties including the compressibility factor and the specific heat at constant volume.

Accordingly, there is an error between the polytropic head $H_{pol}$ calculated based on (formula 3) and the real polytropic head to be obtained. In the embodiment, in order to reduce this error close to zero, the test parameters including the polytropic head $H_{pol}$ are corrected based on the information stored in the test gas physical property correction formula database 32.

In step S103 of FIG. 5, the performance prediction device 3 selects a test gas physical property correction formula from the test gas physical property correction formula database 32. For example, assume that the test gas based on the request from the customer is a test gas obtained by mixing the gases G1$_t$ and G2$_t$ at a certain mix ratio and the molecular weight $Mw___t$ of the test gas is equal to the molecular weight $Mw___{Mix3_t}$ depicted in FIG. 4. In this case, the performance prediction device 3 obtains the correction formula ($Z_{t_cor}$=Az3$_t$×$Z_t$+Bz3$_t$: see FIG. 4) of the compressibility factor which corresponds to the test gas Mix3, from the test gas physical property correction formula database 32.

Meanwhile, there is a case where the molecular weight $Mw___t$ of the test gas actually used in the similitude test is not equal to any of the molecular weights stored in the test gas physical property correction formula database 32. For example, assume that the molecular weight $Mw___t$ of the test gas is greater than the molecular weight $Mw___{Mix1_t}$ of Mix1$_t$ depicted in FIG. 4 and is smaller than the molecular weight $Mw___{Mix2_t}$ of Mix2$_t$. In this case, the performance prediction device 3 obtains coefficients $Az_t$ and $Bz_t$ in the correction formula of the compressibility factor, based on following (formula 6) and (formula 7).

[Math 6]

$$Az_t = (Az1_t - Az2_t) \times \frac{Mw__t - Mw__{Mix2_t}}{Mw__{Mix1_t} - Mw__{Mix2_t}} + Az2_t \quad \text{(formula 6)}$$

[Math 7]

$$Bz_t = (Bz1_t - Bz2_t) \times \frac{Mw__t - Mw__{Mix2_t}}{Mw__{Mix1_t} - Mw__{Mix2_t}} + Bz2_t \quad \text{(formula 7)}$$

As described above, in step S103, the performance prediction device 3 calculates the slope $Az_t$ and the intercept $Bz_t$ of the straight line expressed by the correction formula of the compressibility factor, based on the molecular weights of the respective test gases. Specifically, the performance prediction device 3 obtains the coefficients $Az_t$ and $Bz_t$ in the correction formula of the compressibility factor by performing linear interpolation (proportional calculation), based on a magnitude relationship of the molecular weight $Mw___t$ of the test gas to be used in the prediction with the molecular weights ($Mw___{Mix1_t}$, $Mw___{Mix2_t}$) of the test gases stored in the test gas physical property correction formula database 32. The compressibility factor $Z_{t_cor}$ of the test gas to be used in the prediction can be thereby appropriately calculated even when the number (five in FIG. 4) of correction formulae stored in the test gas physical property correction formula database 32 is relatively small.

In a similar way, the performance prediction device 3 obtains coefficients $Acv_t$ and $Bcv_t$ in the correction formula of the specific heat at constant volume by performing linear interpolation, based on the magnitude relationship of the molecular weight of the test gas to be used in the prediction with the molecular weights of the test gases stored in the test gas physical property correction formula database 32, and then calculates the corrected specific heat at constant volume $Cv_{t_cor}$.

In the following description, a situation where the state quantities are calculated by directly or indirectly using the information stored in the test gas physical property correction formula database 32 is described as "based on the correction calculation."

In step S104 of FIG. 5, in the performance prediction device 3, the test parameter correction unit 33*b* corrects the test parameters (test parameter correction step). Specifically, the performance prediction device 3 calculates a polytropic head $H_{pol_t_cor}$ [J/kg] based on the correction calculation, by using following (formula 8).

Note that $H_{pol_t}$ [J/kg] shown in (formula 8) is a polytropic head before the correction based on (formula 3), and $\kappa_t$ [−] is a heat capacity ratio of the test gas. $Z_t$ [−] is the compressibility factor before the correction and $Z_{t_cor}$ [−] is the corrected compressibility factor. $R_t$ [J/kg·K] is the gas constant of the test gas and $T_{i_k}$ [K] is the intake temperature detected by the intake temperature sensor 19*b*. $Az_t$ and $Bz_t$ are the coefficients in the correction formula of the compressibility factor based on the information stored in the test gas physical property correction formula database 32 and (formula 6) and (formula 7) described above.

[Math 8]

$$H_{pol_t_cor} = H_{pol_t} \times \frac{\frac{\kappa_t}{\kappa_t - 1} Z_{t_cor} R_t T_{i_t} \left\{ (P_{d_t}/P_{i_t})^{\frac{\kappa_t - 1}{\kappa_t}} - 1 \right\}}{\frac{\kappa_t}{\kappa_t - 1} Z_t R_t Z_{t_i} \left\{ (P_{d_t}/P_{i_t})^{\frac{\kappa_t - 1}{\kappa_t}} - 1 \right\}} = H_{pol_t} \times \frac{Z_{t_cor}}{Z_t} = H_{pol_t} \times \frac{Az_t \cdot Z_t + Bz_t}{Z_t} \quad \text{(formula 8)}$$

A denominator and a numerator on the right side of the top line of (formula 8) are each in a form multiplied by adiabatic head including the compressibility factor ($Z_t$ in the denominator, $Z_{t_cor}$ in the numerator) in the case where the test gas is handled as an ideal gas. This can simplify the formula compared to that in the case where the test gas is handled as a real gas as shown in the next line of (formula 8) Moreover, the corrected polytropic head $H_{pol_t_cor}$ can be calculated based on the information (compressibility factor and molecular weights) stored in the test gas physical property correction formula database 32 as shown in the last line of (formula 8).

Note that the heat capacity ratio $\kappa_t$ [−] of the test gas shown in (formula 8) is obtained based on following (formula 9). In this formula, $Cv_t$ [J/kg·K] is the specific heat at constant volume of the test gas in the similitude test and $C\rho_t$ [J/kg·K] is a specific heat at constant pressure of the test gas in the similitude test.

[Math 9]

$$\kappa_t = \frac{Cp_t}{Cv_t} \quad \text{(formula 9)}$$

Furthermore, the performance prediction device 3 calculates a theoretical head $H_{th_t_cor}$ of the compressor 2 based on the correction calculation, by using following (formula 10). The theoretical head is pressure head indicating the effective work of the compressor 2.

Moreover, $Cv_t$ [−] shown in (formula 10) is the specific heat at constant volume before the correction, and $Cv_{t_cor}$ [−] is the corrected specific heat at constant volume. $T_{d_t}$ [K] is the discharge temperature detected by the discharge temperature sensor 19*d* and $Acv_t$ and $Bcv_t$ are the coefficients in the correction formula of the specific heat at constant volume based on the information of the test gas physical property correction formula database 32.

[Math 10]

$$H_{th_i_cor} = \kappa_t \times \frac{Cv_{t_cor}}{Cv_t}(T_{d_t} - T_{i_t}) = \kappa_t \times \frac{Acv_t \cdot Cv_t + Bcv_t}{Cv_t}(T_{d_t} - T_{i_t}) \quad \text{(formula 10)}$$

Next, the performance prediction device 3 plugs the calculation results of (formula 8) and (formula 10) described above into following (formula 11) and obtains a polytropic efficiency $\eta_{pol_t_cor}$ based on the correction calculation. In step S104 of FIG. 5, the performance prediction device 3 thereby calculates the "test parameters" including the polytropic head $H_{pol_t_cor}$ (formula 8) and the polytropic efficiency $\eta_{pol_t_cor}$ (formula 11) based on the correction calculation.

[Math 11]

$$\eta_{pol_t_cor} = \frac{H_{pol_t_cor}}{H_{th_t_cor}} \quad \text{(formula 11)}$$

In step S105 of FIG. 5, in the performance prediction device 3, the on-site performance parameter calculation unit 33*c* obtains the on-site performance parameters (discharge pressure and power of the compressor 2 on the site).

For example, the performance prediction device 3 obtains a discharge pressure $P_{d_sp}$ [Pa] of the compressor 2 under the on-site operation condition based on the correction calculation, by performing a series of convergence calculations described below. Note that the subscript sp indicates that a value is based on the on-site operation condition, and the value of the discharge pressure $P_{d_sp}$ [Pa] under the on-site operation condition is normally different from the detection value of the discharge pressure sensor 19*e* (see FIG. 1) in the similitude test.

First, the performance prediction device 3 obtains an enthalpy $h_{d_sp}$ [J/kg] on the discharge side of the compressor 2 under the on-site operation condition, based on following (formula 12). Note that $h_{i_sp}$ [J/kg] is an enthalpy on the intake side of the compressor 2 under the on-site operation condition. $H_{pol_t}$ [J/kg] is the polytropic head of the compressor 2 in the similitude test and is obtained based on (formula 3) described above. $\eta_{pol_t}$ [−] is a polytropic efficiency of the compressor 2 in the similitude test and is obtained by a well-known method based on the polytropic head $H_{pol_t}$.

[Math 12]

$$h_{d_sp} = h_{i_sp} + \frac{H_{pol_t}}{\eta_{pol_t}} \quad \text{(formula 12)}$$

Next, the performance prediction device 3 assumes a certain discharge pressure $P_{d_sp_as}$ [PA] under an isenthalpic condition where the enthalpy is constant at $h_{d_sp}$ calculated in (formula 12), and calculates a temporary polytropic head $H_{pol_t_as}$ [J/kg] by using following (formula 13).

Note that $n_{sp}$ [−] shown in (formula 13) is a polytropic exponent under the on-site operation condition and is calculated in a method similar to that of (formula 4). $f_t$ [−] is the polytropic factor and is calculated based on (formula 5). $P_{d_sp}$ [K] and $v_{d_sp}$ [$m^3$/kg] are a discharge pressure and a specific volume of the compressor 2 under the on-site operation condition, and $P_{i_sp}$ [K] and $v_{i_sp}$ [$m^3$/kg] are an intake pressure and a specific volume of the compressor 2 under the on-site operation condition.

[Math 13]

$$H_{pol_t_as} = \frac{n_{sp}}{n_{sp}-1} f_t \times (P_{d_sp_as} v_{d_sp} - P_{i_sp} v_{i_sp}) \quad \text{(formula 13)}$$

When the temporary polytropic head $H_{pol_t_as}$ [J/kg] is smaller than the polytropic head $H_{pol_t}$ [J/kg] based on the similitude test, the performance prediction device 3 sets the temporary discharge pressure $P_{d_sp_as}$ [PA] to a value greater than that in the previous assumption and recalculates the discharge temperature $T_{d_sp}$ [K], the specific volume $v_{d_sp}$ and the like under the on-site operation condition with the enthalpy $h_{d_sp}$ being constant. Then the performance prediction device 3 repeats the calculation based on (formula 12) and (formula 13) until the temporary polytropic head $H_{pol_t_as}$ matches the polytropic head $H_{pol_t}$ in the similitude test.

The performance prediction device 3 thereby calculates a discharge pressure $P_{d_sp_cor}$ of the compressor 2 under the on-site operation condition based on the correction calculation.

Moreover, before obtaining power $Pw_{sp_cor}$ [W] of the compressor 2 under the on-site operation condition based on the correction calculation, the performance prediction device 3 calculates an intake mass flow rate $G_{i_sp_cor}$ [kg/s] of the compressor 2 under the on-site operation condition based on the correction calculation, by using following (formula 14), to obtain the power $Pw_{sp_cor}$.

Note that $Q_{i_sp}$ [$m^3$/s] shown in (formula 14) is an intake volume flow rate of the compressor 2 under the on-site operation condition which is given by a user as a specification. $Z_{sp}$ [−] is a calculated value of the compressibility factor under the on-site operation condition and is obtained in a method similar to that of (formula 2). $T_{i_sp}$ [K] is an intake temperature of the compressor 2 under the on-site operation condition and $P_{i_sp}$ [K] is an intake pressure of the compressor 2 under the on-site operation condition.

[Math 14]

$$G_{i_sp_cor} = Q_{i_sp} \times \frac{P_{i_sp}}{Z_{sp} R_{sp} T_{i_sp}} \quad \text{(formula 14)}$$

Then the performance prediction device 3 calculates the power $Pw_{sp_cor}$ [W] of the compressor 2 under the on-site operation condition based on the correction calculation, by using following (formula 15). Note that $\kappa_{sp}$ [−] shown in (formula 15) is a heat capacity ratio of an on-site gas and is obtained in a method similar to that of (formula 9). $Cv_{sp}$ [J/kg·K] is a specific heat at constant volume of the test gas and is calculated based on the composition of the on-site gas given in advance by the user, by known calculating means in accordance with the on-site operation condition given as the specification.

[Math 15]

$$Pw_{sp_cor} = G_{i_sp_cor} \times \kappa_{sp} \times Cv_{sp}(T_{d_t} - T_{i_t}) \quad \text{(formula 15)}$$

The performance prediction device 3 thereby calculates the "on-site performance parameters" including the discharge pressure $P_{d_sp_cor}$ (convergence calculation) and the power $Pw_{sp_cor}$ (formula 15) under the on-site operation condition in step S105 of FIG. 5.

In step S106 of FIG. 5, in the performance prediction device 3, the pass/fail determination unit 33*d* performs pass/fail determination processing relating to the performance of the compressor 2. For example, when the polytropic head $H_{pol_t_cor}$ based on the correction calculation is equal to or greater than 100% and less than 105% of a predetermined request value and the power $Pw_{sp_cor}$ under the on-site operation condition is equal to or less than 107% of a predetermined request value, the performance prediction device 3 determines that the compressor 2 satisfies the requirements relating to the performance.

Meanwhile, when the polytropic head $H_{pol_t_cor}$ based on the correction calculation is outside the range described above or when the power $Pw_{sp_cor}$ under the on-site operation condition is outside the range described above, the performance prediction device 3 determines that the compressor 2 does not satisfy the requirements relating to the performance.

Note that the polytropic efficiency $\eta_{pol_t_cor}$ based on the correction calculation and the discharge pressure $P_{d_sp_cor}$ under the on-site operation condition may be added to the criteria of the pass/fail determination.

In step S107 of FIG. 5, in the performance prediction device 3, the display control unit 34 displays, for example, the calculation results of (formula 1) to (formula 15) and the result of the pass/fail determination processing in step S106 on the display device 4. A manager of the performance prediction device 3 can thereby understand the information relating to the performance of the compressor 2 and take certain measures in consideration of the determination result of pass or fail. For example, when the polytropic head of the compressor 2 is insufficient, surfaces (not illustrated) of the rotor blades and a casing interior of the compressor 2 through which the gas flows are polished or an operation method of the compressor 2 is changed, and the similitude test of the compressor 2 is performed again.

<Effects>

In the embodiment, storing the information on the physical properties of the test gases in the test gas physical property correction formula database 32 in advance enables correction of the test parameters by use of the compressibility factor $Z_{t_cor}$ and the specific heat at constant volume $Cv_{t_cor}$ based on the test gas physical property correction formulae. Accordingly, it is unnecessary that, every time a customer specifies a test gas, a large amount of the specified test gas is produced and the similitude test of the compressor 2 is performed. Moreover, the test parameters of the compressor 2 can be accurately calculated.

Moreover, in the embodiment, the coefficients of the gas physical property correction formulae are calculated by performing the linear interpolation based on (formula 6) and (formula 7) described above. Accordingly, the coefficients $Az_t$, $Bz_t$, $Acv_t$, and $Bcv_t$ relating to a desired test gas can be calculated based on the linear interpolation by preparing, for example, five test gas physical property correction formulae (see FIG. 4) each associated with a certain mix ratio of the two types of gases $G1_t$ and $G2_t$.

Second Embodiment

A performance prediction device 3A (see FIG. 6) in a second embodiment is different from the performance prediction device in the first embodiment in that it includes an on-site gas physical property correction formula database 35 and an on-site performance parameter correction unit 33*e*. Moreover, in the second embodiment, processing contents of a pass/fail determination unit 33*f* (see FIG. 6) are different from those of the pass/fail determination unit 33*d* (see FIG. 2) described in the first embodiment. Note that other configurations of the second embodiment are the same as those of the first embodiment (see FIG. 2). Accordingly, description is given of portions different from the first embodiment, and overlapping description is omitted.

<Configuration of Performance Prediction Device>

Figure 6:
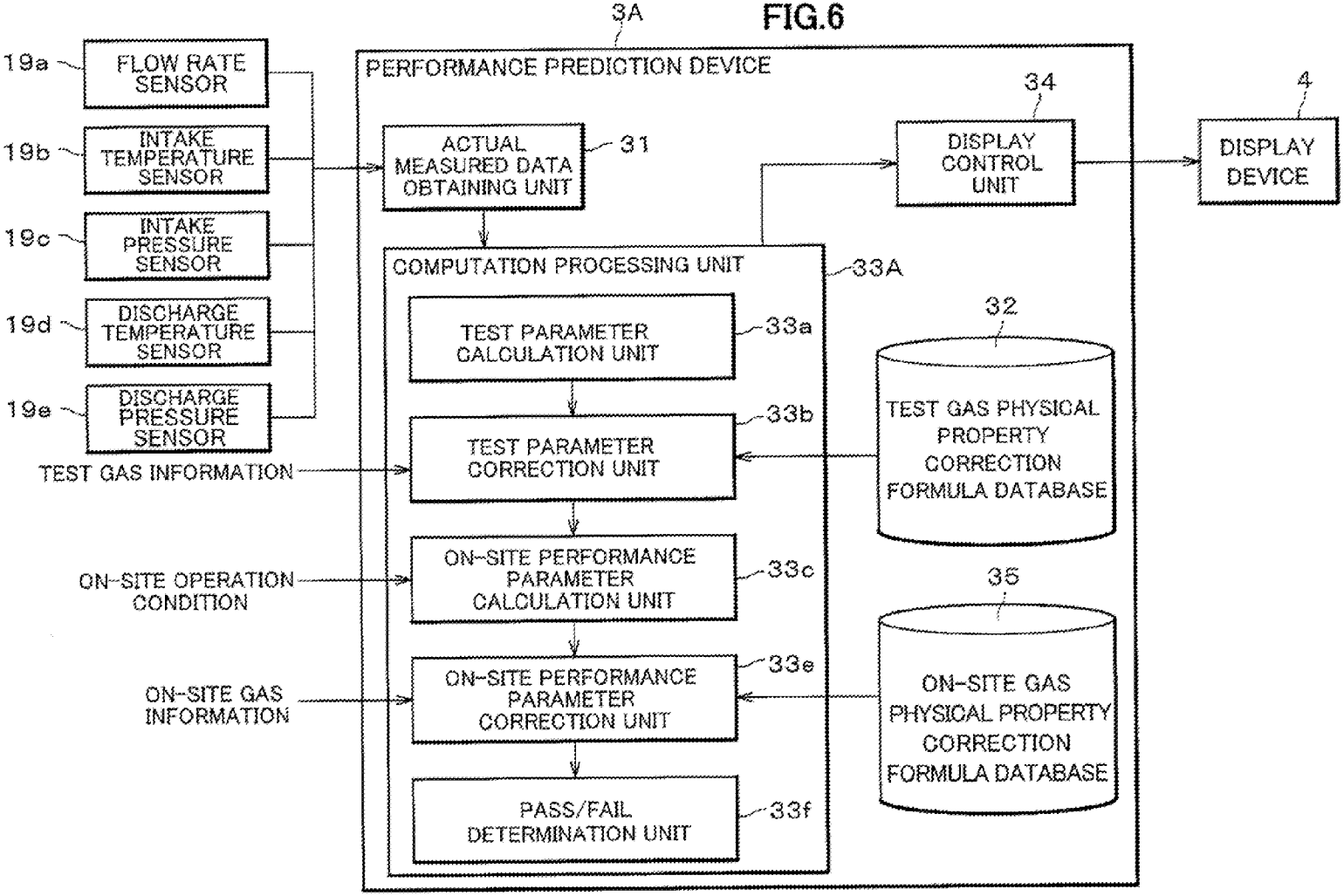
FIG. 6 is a functional block diagram of a performance prediction device in a second embodiment of the present invention.

FIG. 6 is a functional block diagram of the performance prediction device 3A in the second embodiment.

As illustrated in FIG. 6, the performance prediction device 3A includes actual measured data obtaining unit 31, a test gas physical property correction formula database 32, the on-site gas physical property correction formula database 35, computation processing unit 33A, and display control unit 34.

The on-site gas physical property correction formula database stores on-site gas physical property correction formulae indicating relationships among: on-site gas physical properties (compressibility factor and specific heat at constant volume) of an on-site gas assumed to be compressed by a compressor 2 on the site; and on-site gas physical properties of multiple on-site gases which are different in a mix ratio of gases.

The "on-site gases" described above are gases actually compressed by the compressor 2 on the site (for example, in a chemical plant) different from a test facility 1 (see FIG. 1). Note that, when a customer of the compressor 2 is known, a manager of the performance prediction device 3A can assume main gases included in the on-site gas.

In the embodiment, gas properties of the on-site gases are stored as a database based on gas physical priority measurement experiments performed in advance, and on-site performance parameters (discharge pressure and power) are corrected based on an actual composition of the on-site gas notified by the customer thereafter.

FIG. 7 is an explanatory diagram illustrating information stored in the on-site gas physical property correction formula database 35. In the embodiment, description is given of an example in which gases obtained by mixing two types of gases $Ga_{sp}$ and $Gb_{sp}$ (including a case where one of the gases is 100% and the other one is 0%) are used as the on-site gases.

As depicted in FIG. 7, correction formulae of the compressibility factor for on-site gases $MIX1_{sp}$ to $MIX5_{sp}$ and correction formulae of the specific heat at constant volume for the on-site gases $MIX1_{sp}$ to $MIX5_{sp}$ are stored in the on-site gas physical property correction formula database 35 while being associated with types and mix ratios of the gases $Ga_{sp}$ and $Gb_{sp}$ included in on-site gases and molecular weights of the on-site gases.

Note that a method of deriving the correction formula of the compressibility factor and a method of deriving the correction formula of the specific heat at constant volume are the same as those in the first embodiment. For example, coefficients $Az2_{sp}$ and $Bz2_{sp}$ of a function $Z_{sp_cor}=Az2_{sp}\times Z_{sp}+Bz2_{sp}$ are obtained by performing linear approximation of points based on the least squares method, the points determined by a compressibility factor (actual measured value) of an (assumed) on-site gas obtained by mixing the gases $Ga_{sp}$ and $Gb_{sp}$ at a mix ratio of 80% to 20% and a compressibility factor (calculated value) of an on-site gas including the gases $Ga_{sp}$ and $Gb_{sp}$ at a certain ratio. This is also the same for the specific heat at constant volume $Cv_{sp}$.

Unlike the similitude test using a large amount of test gas, the gas physical property measurement experiment performed in advance to derive the correction formulae depicted in FIG. 7 requires a relatively small amount of on-site gases. Accordingly, although the similitude tests using on-site gases with complex compositions are difficult to perform, the experiments performed in advance to derive the correction formulae for such on-site gases can be performed relatively easily.

The computation processing unit 33A illustrated in FIG. 6 includes a test parameter calculation unit 33*a*, a test parameter correction unit 33*b*, an on-site performance parameter calculation unit 33*c*, the on-site performance parameter correction unit 33*e*, and the pass/fail determination unit 33*f*.

The on-site performance parameter correction unit 33*e* has a function of correcting the on-site performance parameters, based on the composition (types and a mix ratio of gases included in the on-site gas) of the on-site gas actually compressed by the compressor 2 on the site. The on-site performance parameters refer to a discharge pressure $P_{d_sp_cor}$ of the compressor 2 and power $Pw_{sp_cor}$ required to operate the compressor 2 as described in the first embodiment.

The pass/fail determination unit 33*f* has a function of determining whether the compressor 2 satisfies predetermined requirements relating to the performance, based on test parameters corrected by the test parameter correction unit 33*b* and the on-site performance parameters corrected by the on-site performance parameter correction unit 33*e*. Processing executed by the on-site performance parameter correction unit 33*e* and the pass/fail determination unit 33*f* will be described later.

<Processing of Performance Prediction Device>

Figure 8:
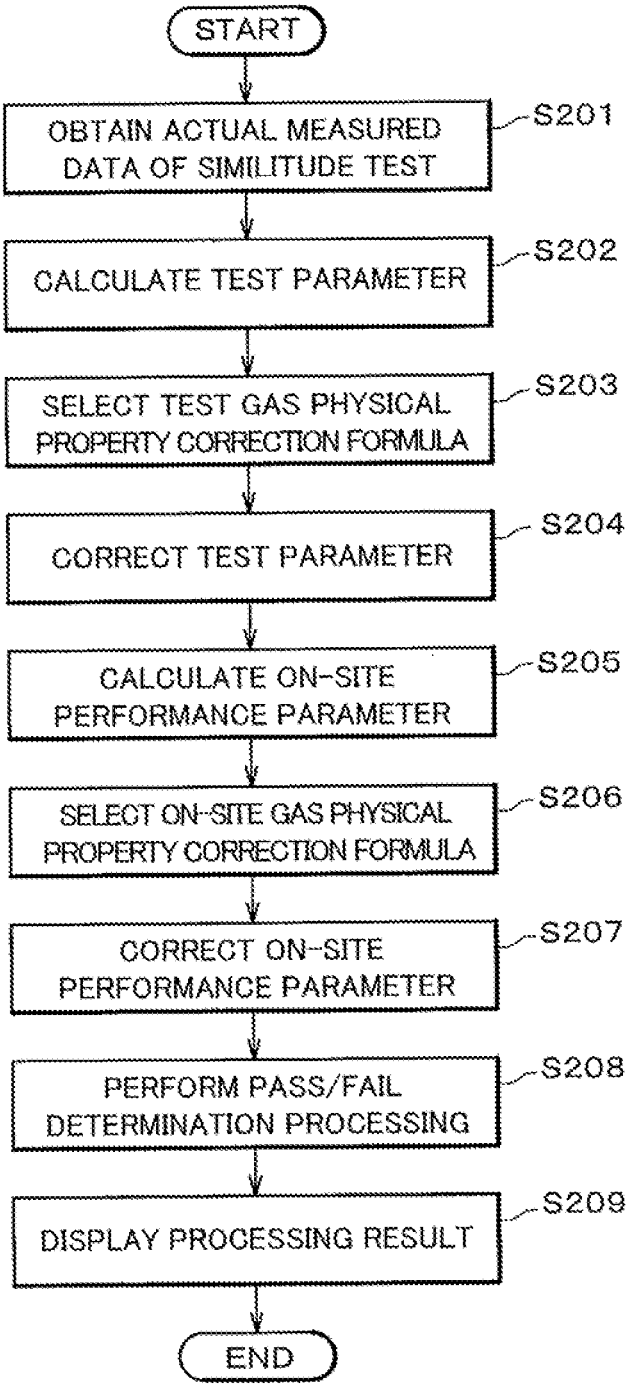
FIG. 8 is a flowchart illustrating processing executed by the performance prediction device.

FIG. 8 is a flowchart illustrating processing executed by the performance prediction device 3A.

Since steps S201 to S204 are the same as steps S101 to S104 (see FIG. 5) described in the first embodiment, description thereof is omitted. Note that certain devices (not illustrated) are installed upstream and downstream of the compressor 2 on the site, and test conditions such as the length of a straight portion of a pipe to a temperature and pressure measurement position on the intake side which complies with PTC 10 cannot be achieved (the same applies to the discharge side). Accordingly, it is difficult to correctly determine pass or fail of the performance of the compressor 2 with respect to a specification requested by the user, by using a polytropic head $H_{pol_t_cor}$ (formula 8) and a polytropic efficiency $\eta_{pol_t_cor}$ (formula 11) of the compressor 2 under the on-site operation condition. Hence, also in the embodiment, the polytropic head $H_{pol_t_cor}$ and the polytropic efficiency $\eta_{pol_t_cor}$ cor are calculated by methods similar to those in the first embodiment, based on results of the similitude test using the test gas.

In step S205 of FIG. 8, in the performance prediction device 3A, the on-site performance parameter calculation unit 33*c* calculates the on-site performance parameters of the compressor 2. First, the performance prediction device 3A calculates a polytropic exponent $n_{sp}$ under the on-site operation condition based on following (formula 16). Note that $\eta_{pol_t}$ [−] is a polytropic efficiency in the similitude test, and $\kappa_{sp}$ [−] is a heat capacity ratio of the on-site gas.

[Math 16]

$$n_{sp} = \frac{\eta_{pol_t}}{\eta_{pol_t} - (\kappa_{sp} - 1)/\kappa_{sp}} \quad \text{(formula 16)}$$

The polytropic efficiency $\eta_{pol_t}$ shown in (formula 16) is calculated based on, for example, following (formula 17). Note that a polytropic exponent $n_t$ shown in (formula 17) is calculated based on (formula 4) described in the first embodiment, and a polytropic factor $f_t$ is calculated based on (formula 5).

Moreover, a discharge gas enthalpy $h_{d_t}$ [J/kg], an intake gas enthalpy $h_{i_t}$ [J/kg], a discharge pressure $P_{d_t}$ [m$^3$/kg], an intake pressure $P_{i_t}$ [m$^3$/kg], a discharge gas specific volume $V_{d_t}$ [m$^3$/kg] and an intake gas specific volume $V_{i_t}$ [m$^3$/kg] which are shown in (formula 17) are obtained by well-known methods, based on the results of the similitude test.

[Math 17]

$$\eta_{pol_t} = \frac{\frac{n_t}{n_t - 1} f_t}{h_{d_t} - h_{i_t}} \times (P_{d_t} v_{d_t} - P_{i_t} v_{i_t}) \quad \text{(formula 17)}$$

Moreover, the performance prediction device 3A calculates the heat capacity ratio $\kappa_{sp}$ of the on-site gas based on following (formula 18). Note that $Cp_{sp}$ [J/kg·K] shown in (formula 18) is a specific heat at constant pressure of the on-site gas and $Cv_{sp}$ [J/kg·K] is the specific heat at constant volume of the on-site gas.

[Math 18]

$$\kappa_{sp} = \frac{Cp_{sp}}{Cv_{sp}} \quad \text{(formula 18)}$$

Moreover, the performance prediction device 3A calculates a polytropic exponent $n_{sp_cor}$ [−] based on correction calculation, by using following (formula 19). Note that $\eta_{pol_t_cor}$ shown in (formula 19) is a polytropic efficiency based on the correction calculation as described in (formula 11) in the first embodiment.

[Math 19]

$$n_{sp_cor} = \frac{\eta_{pol_t_cor}}{\eta_{pol_t_cor} - (\kappa_{sp} - 1)/\kappa_{sp}} \quad \text{(formula 19)}$$

Next, the performance prediction device 3A obtains a discharge pressure $P_{d_sp_id}$ [Pa] of the compressor 2 under the on-site operation condition in the case where the on-site gas is handled as an ideal gas, by using following (formula 20).

Note that $P_{i_sp}$ [Pa] shown in (formula 20) is an intake pressure of the compressor 2 given based on the on-site specification. A polytropic head $H_{pol_t}$ [J/kg] is a polytropic head of the compressor 2 in the similitude test as described in (formula 3) of the first embodiment.

Moreover, $Z_{sp}$ [−] shown in (formula 20) is an assumed compressibility factor of the on-site gas and is obtained in advance by calculation in a way similar to the compressibility factor $Z_t$ (calculated value) described in the first embodiment. Furthermore, $R_{sp}$ [J/kg·K] is a gas constant of the on-site gas and $T_{i_sp}$ [K] is an intake temperature of the compressor 2 given based on the on-site specification.

[Math 20]

$$P_{d_sp_id} = P_{i_sp} \times \left(1 + \frac{H_{pol_t}}{\frac{n_{sp}}{n_{sp} - 1} Z_{sp} R_{sp} T_{i_sp}}\right)^{\frac{n_{sp}}{n_{sp}-1}} \quad \text{(formula 20)}$$

The compressibility factor $Z_{sp}$ [−] shown in (formula 20) is a compressibility factor obtained by a well-known method for an on-site gas obtained by mixing the two types of gases $Ga_{sp}$ and $Gb_{sp}$ at a certain ratio, which is based on assumption made in advance that, for example, the gases $Ga_{sp}$ and $Gb_{sp}$ are included in the on-site gas. Specifically, when the certain ratio of the gases $Ga_{sp}$ and $Gb_{sp}$ based on the assumption made in advance and the composition of the on-site gas notified by the customer are different from each other, there is an error between the discharge pressure $P_{d_sp_id}$ [Pa] obtained based on (formula 20) and the discharge pressure in a situation where the on-site gas is actually compressed by the compressor 2.

Accordingly, in the embodiment, the on-site performance parameters (discharge pressure and power) are corrected based on the composition of the on-site gas notified by the customer ("on-site gas information" depicted in FIG. 6) and the information stored in the on-site gas physical property correction formula database 35.

Note that the composition of the on-site gas notified by the customer (types and a mix ratio of gases included in the on-site gas) is inputted into the performance prediction device 3A by a manager.

In step S206 of FIG. 8, in the performance prediction device 3A, the on-site performance parameter correction unit 33*e* selects an on-site gas physical property correction formula from the on-site gas physical property correction formula database 35.

For example, when a molecular weight $Mw_{sp}$ of the on-site gas notified by the customer is equal to a molecular weight $Mw_{Mix3_sp}$ stored in the on-site gas physical property correction formula database 35, the performance prediction device 3A obtains a correction formula ($Z_{sp_cor}$=$AZ3_{sp}$×$Z_{sp}$+$BZ3_{sp}$) of the compressibility factor which corresponds to the on-site gas $Mix3_{sp}$.

Meanwhile, there is a case where the molecular weight $Mw_{sp}$ of the on-site notified by the customer is not equal to any of the molecular weights stored in the on-site gas physical property correction formula database 35. For example, assume that the molecular weight $Mw_{sp}$ of the on-site gas is greater than the molecular weight $Mw_{Mix1_sp}$ of $Mix1_{sp}$ depicted in FIG. 7 and is smaller than the molecular weight $Mw_{Mix2_sp}$ of $Mix2_{sp}$. In this case, the performance prediction device 3A obtains coefficients $Az_{sp}$ and $Bz_{sp}$ in the correction formula of the compressibility factor, based on following (formula 21) and (formula 22).

[Math 21]

$$Az_{sp} = (Az1_{sp} - Az2_{sp}) \times \frac{Mw_{_sp} - Mw_{_Mix2_sp}}{Mw_{_Mix1_sp} - Mw_{_Mix2_sp}} + Az2_{sp} \quad \text{(formula 21)}$$

[Math 22]

$$Bz_{sp} = (Bz1_{sp} - Bz2_{sp}) \times \frac{Mw_{_sp} - Mw_{_Mix2_sp}}{Mw_{_Mix1_sp} - Mw_{_Mix2_sp}} + Bz2_{sp} \quad \text{(formula 22)}$$

As described above, the performance prediction device 3A obtains the coefficients $Az_{sp}$ and $Bz_{sp}$ in the correction formula of the compressibility factor by performing linear interpolation, based on magnitude relationships of the molecular weight of the on-site gas actually compressed by the compressor 2 on the site with the molecular weights of the on-site gases stored in the on-site gas physical property correction formula database 35. Coefficients $Acv_{sp}$ and $Bcv_{sp}$ in the correction formula of the specific heat at constant volume are also obtained by linear interpolation in a similar way.

In step S207 of FIG. 8, in the performance prediction device 3A, the on-site performance parameter correction unit 33*e* corrects the on-site performance parameters (discharge pressure and power). First, the performance prediction device 3A calculates a discharge pressure $P_{d_sp_id_cor}$ [Pa] of the compressor 2 under the on-site operation condition in the case where the on-site gas is handled as an ideal gas, based on following (formula 23).

Note that $P_{i_sp}$ [Pa] shown in (formula 23) is an intake pressure given based on the on-site specification. $H_{pol_t_cor}$ [J/kg] is a polytropic head in the similitude test based on the correction calculation and is obtained based on (formula 8) described above. $n_{sp_cor}$ [−] is a polytropic exponent under the on-site operation condition based on the correction calculation and is obtained based on (formula 19) described above.

Moreover, $Z_{sp_cop}$ [−] shown in (formula 23) is a correction value of the compressibility factor of the on-site gas and $Z_{sp}$ [−] is a compressibility factor obtained by a well-known method for the on-site gas obtained by mixing the two types of gases $Ga_{sp}$ and $Gb_{sp}$ at a certain ratio, which is based on the assumption made in advance that the gases $Ga_{sp}$ and $Gb_{sp}$ are included in the on-site gas. Moreover, $Az_{sp}$ and $Bz_{sp}$ are the coefficients of the correction formula of the compressibility factor based on the information in the on-site gas physical property correction formula database 35.

[Math 23]

$$P_{d_sp_id_cor} = P_{i_sp} \times \left(1 + \frac{H_{pol_t_cor}}{\frac{n_{sp_cor}}{n_{sp_cor}-1} Z_{sp_cor} R_{sp} T_{i_sp}}\right)^{\frac{n_{sp_cor}}{n_{sp_cor}-1}} = P_{i_sp} \times \left(1 + \frac{H_{pol_t_cor}}{\frac{n_{sp_cor}}{n_{sp_cor}-1} \times \frac{Az_{sp} \cdot Z_{sp} + Bz_{sp}}{Z_{sp}} R_{sp} T_{i_sp}}\right)^{\frac{n_{sp_cor}}{n_{sp_cor}-1}} \quad \text{(formula 23)}$$

Then, the performance prediction device 3A obtains the discharge pressure $P_{d_sp_cor}$ [Pa] of the compressor 2 under the on-site operation condition based on the correction calculation, by using following (formula 24). Note that $P_{d_sp}$ [Pa] shown in (formula 24) is a discharge pressure of the compressor 2 under the on-site operation condition and is obtained based on predetermined convergence calculation ((formula 12) and (formula 13)) as in the first embodiment.

[Math 24]

$$P_{d_sp_cor} = P_{d_sp} \times \frac{P_{d_sp_id_cor}}{P_{d_sp_id}} \quad \text{(formula 24)}$$

Moreover, before obtaining the power $Pw_{sp_cor}$ [W] of the compressor 2 under the on-site operation condition based on the correction calculation, the performance prediction device 3A calculates an intake mass flow rate $G_{i_sp_cor}$ [kg/s] of the compressor 2 under the on-site operation condition, by using following (formula 25), to obtain the power $Pw_{sp_cor}$.

Note that $Q_{i_sp}$ [$m^3$/s] shown in (formula 25) is an intake volume flow rate of the compressor 2 under the on-site operation condition which is given as a specification. The compressibility factor $Z_{sp}$ [−], the coefficients $Az_{sp}$ and $Bz_{sp}$ of the correction formula of the compressibility factor $Z_{sp}$ the gas constant $R_{sp}$ [J/K·kg] of the on-site gas, the intake temperature $T_{i_sp}$ [K] of the compressor 2 under the on-site operation condition, and the intake pressure $P_{i_sp}$ [Pa] are as described above.

[Math 25]

$$G_{i_sp_cor} = Q_{i_sp} \times \frac{P_{i_sp}}{\frac{Az_{sp} \cdot Z_{sp} + Bz_{sp}}{Z_{sp}} R_{sp} T_{i_sp}} \quad \text{(formula 25)}$$

Then the performance prediction device 3A calculates the power $Pw_{sp_cor}$ [W] of the compressor 2 under the on-site operation condition based on the correction calculation, by using following (formula 26). Note that $\kappa_{sp}$ [−] shown in (formula 26) is a heat capacity ratio of the on-site gas and is calculated in a method similar to that of (formula 9). $Cv_{sp_cor}$ [J/kg·K] is a correction value of the specific heat at constant volume of the on-site gas under the on-site operation condition and is obtained based on the information in the on-site gas physical property correction formula database 35. The coefficients $Acv_{sp}$ and $Bcv_{sp}$ are obtained by linear interpolation in a method similar to that for the aforementioned coefficients $Az_{sp}$ and $Bz_{sp}$ ((formula 21) and (formula 22)) relating to the compressibility factor.

[Math 26]

$$Pw_{sp_cor} = G_{i_sp_cor} \times \kappa_{sp} \times \frac{Cv_{sp_cor}}{Cv_{sp}} (T_{d_t} - T_{i_t}) = G_{i_sp_cor} \times \kappa_{sp} \times \frac{Acv_{sp} \cdot Cv_{sp} + Bcv_{sp}}{Cv_{sp}} (T_{d_t} - T_{i_t}) \quad \text{(formula 26)}$$

The performance prediction device 3A thereby calculates the on-site performance parameters including the discharge pressure $P_{d_sp_cor}$ and the power $Pw_{sp_cor}$ of the compressor 2 under the on-site operation condition based on the correction calculation in step S207 of FIG. 8.

In step S208 of FIG. 8, in the performance prediction device 3A, the pass/fail determination unit 33*f* performs pass/fail determination processing relating to the performance of the compressor 2. Specifically, when the corrected test parameters (polytropic head $H_{pol_t_cor}$ and polytropic efficiency $\eta_{pol_t_cor}$) are within predetermined ranges and the corrected on-site performance parameters (discharge pressure $P_{d_sp_cor}$ and power $Pw_{sp_cor}$) are within predetermined ranges, the performance prediction device 3A determines that the compressor 2 satisfies the requirements relating to the performance.

In step S209 of FIG. 8, in the performance prediction device 3A, the display control unit 34 displays, for example, a series of processing results of steps S201 to S208 on a display device 4.

<Effects>

In the embodiment, storing the information on the physical properties of the on-site gases in the on-site gas physical property correction formula database 35 in advance enables calculation of the correction values of the on-site performance parameters by use of the corrected compressibility factor $Z_{sp_cor}$ and the corrected specific heat at constant volume $Cvs_{p_cor}$ based on the on-site gas physical property correction formula. Accordingly, whether the compressor 2 passes or fails the performance requirements can be determined more appropriately than in the first embodiment.

Third Embodiment

A third embodiment is carried out when test parameters are obtained from results acquired by executing in advance a test in which some sort of performance is evaluated and which corresponds to a similitude test. A performance prediction device 3B in the third embodiment includes test parameter obtaining unit 36 (see FIG. 9) instead of the actual measured data obtaining unit 31 (see FIG. 6) described in the second embodiment and has a configuration in which the test gas physical property correction formula database 32, the test parameter calculation unit 33*a*, and the test parameter correction unit 33*b* are omitted from the configuration (see FIG. 6) described in the second embodiment. Other configurations of the performance prediction device 3B are the same as those of the performance prediction device in the second embodiment. Accordingly, description is given of portions different from the second embodiment and overlapping description is omitted.

<Configuration of Performance Prediction Device>

Figure 9:
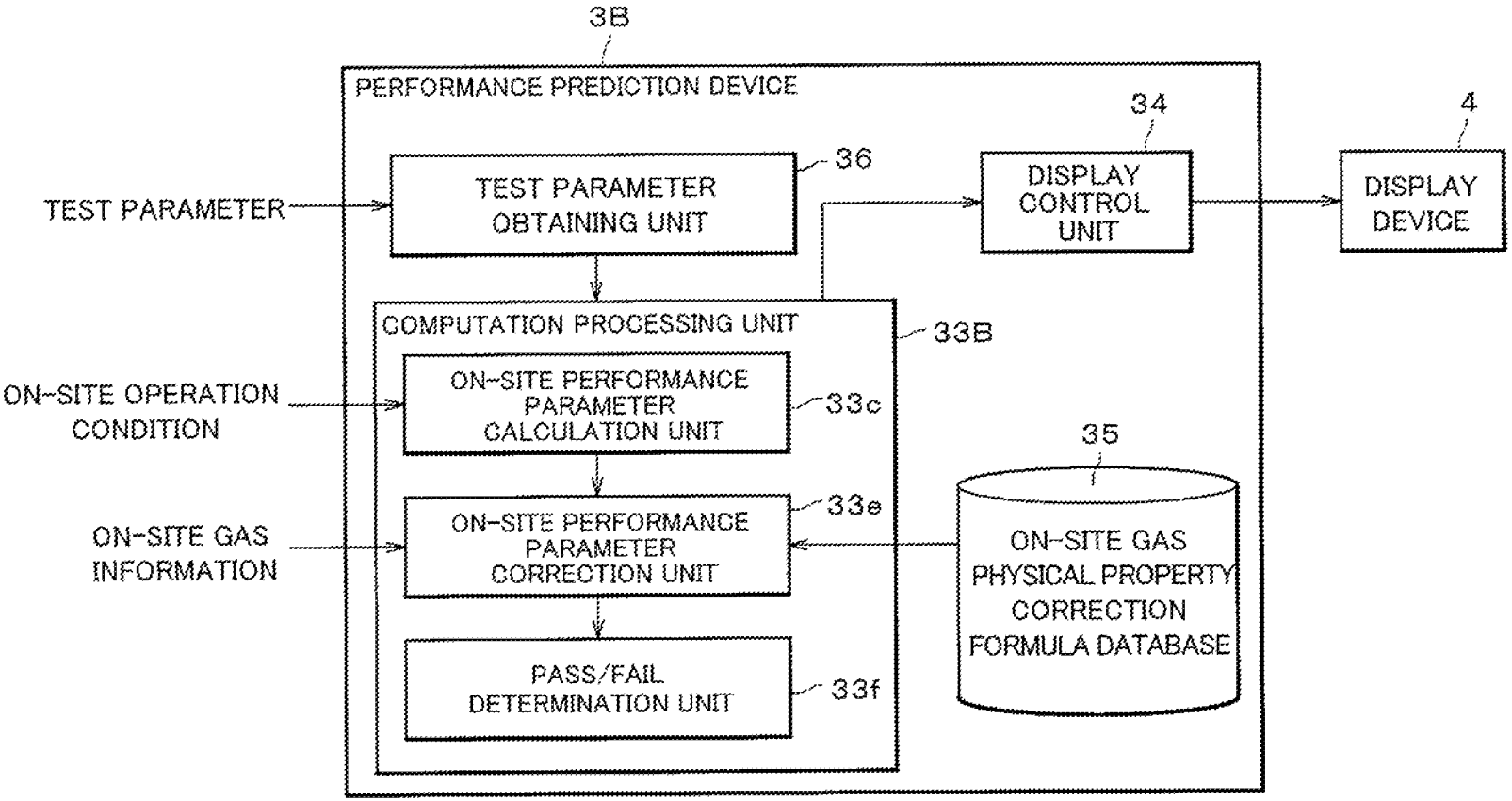
FIG. 9 is a functional block diagram of a performance prediction device in a third embodiment of the present invention.

FIG. 9 is a functional block diagram of the performance prediction device 3B in the third embodiment.

As illustrated in FIG. 9, the performance prediction device 3B includes the test parameter obtaining unit 36, an on-site gas physical property correction formula database 35, computation processing unit 33B, and display control unit 34.

The test parameter obtaining unit 36 has a function of obtaining test parameters including a polytropic head and a polytropic efficiency of a compressor 2. For example, test parameters including a polytropic head $H_{pol_t_cor}$ (formula 8) and a polytropic efficiency $\eta_{pol_t_cor}$ (formula 11) based on correction calculation may be calculated in another computer (not illustrated) based on results of the similitude test and then inputted into the performance prediction device 3B from the computer. Moreover, numeric values of the test parameters may be inputted into the performance prediction device 3B by, for example, an operation of a manager on a keyboard (not illustrated).

The computation processing unit 33B includes an on-site performance parameter calculation unit 33*c*, an on-site performance parameter correction unit 33*e*, and a pass/fail determination unit 33*f*.

The on-site performance parameter calculation unit 33*c* has a function of calculating on-site performance parameters (discharge pressure and power) of the compressor 2 based on the test parameters obtained by the test parameter obtaining unit 36 and an on-site operation condition at which to operate the compressor 2 on the site.

Since the on-site performance parameter calculation unit 33*c* and the pass/fail determination unit 33*f* are the same as those in the second embodiment, description thereof is omitted.

<Processing of Performance Prediction Device>

Figure 10:
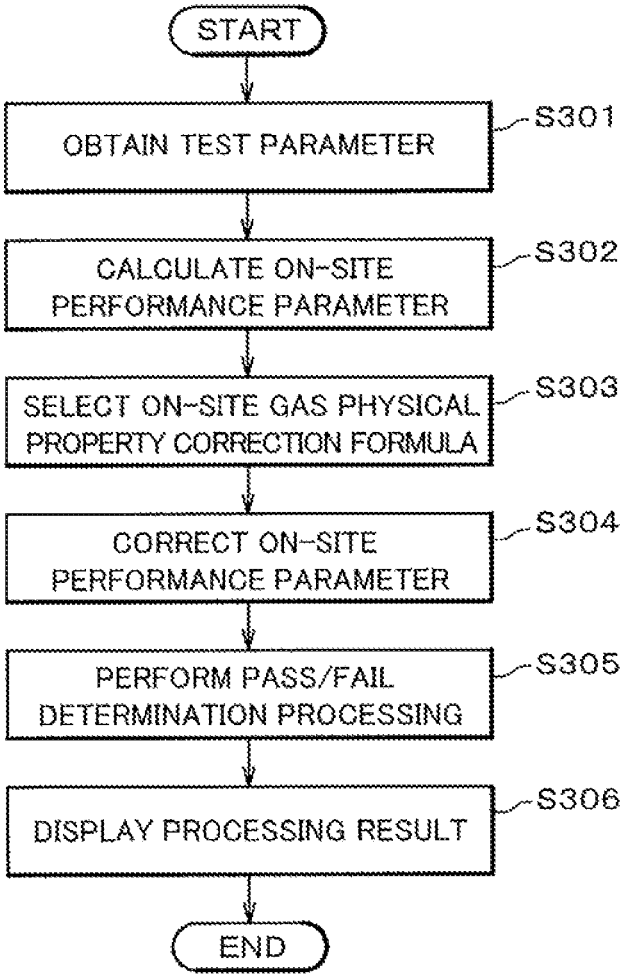
FIG. 10 is a flowchart illustrating processing executed by the performance prediction device.

FIG. 10 is a flowchart illustrating processing executed by the performance prediction device 3B.

In step S301, in the performance prediction device 3B, the test parameter obtaining unit 36 obtains the test parameters including the polytropic head and the polytropic efficiency. As described above, the test parameters may be obtained from another computer (not illustrated) or inputted by an operation of a manager.

In step S302, in the performance prediction device 3B, the on-site performance parameter calculation unit 33*c* calculates the on-site performance parameters including the discharge pressure before correction. Specifically, the performance prediction device 3B calculates the on-site performance parameters of the compressor 2, based on the test parameters obtained in step S301 and the on-site operation condition of the compressor 2 inputted by the manager. Note that since the processing in step S302 is the same as the processing in step S205 (see FIG. 8) described in the second embodiment, detailed description thereof is omitted.

Moreover, since the processing of steps S303 and S304 is the same as the processing of steps S206 and S207 (see FIG. 8) described in the second embodiment, description thereof is omitted.

In step S305, in the performance prediction device 3B, the pass/fail determination unit 33*f* determines that the compressor 2 satisfies requirements relating to the performance, when the corrected on-site performance parameters obtained in step S304 are within predetermined ranges.

In step S306, in the performance prediction device 3B, the display control unit 34 displays, for example, a series of processing results of steps S301 to S305 on a display device 4.

<Effects>

In the embodiment, it is possible to calculate the on-site performance parameters of the compressor 2 based on the test parameters and the like obtained by the test parameter obtaining unit 36 and also correct the on-site performance parameters based on information stored in the on-site gas physical property correction formula database 35. Accordingly, whether the compressor 2 passes or fails the performance requirements can be easily and appropriately determined.

Modified Examples

Although the performance prediction devices 3, 3A, and 3B of the present invention are described above, the present invention is not limited to the devices described above and various changes can be made.

For example, in the first embodiment, description is given of the case where the pieces of information are stored in the test gas physical property correction formula database 32 (see FIG. 4), in correspondence with the five test gases Mix$\mathbf{1}_t$ to Mix$\mathbf{5}_t$ which are different in mix ratio of the gases G$\mathbf{1}_t$ and G$\mathbf{2}_t$. However, the present invention is not limited to this configuration. Specifically, the number of test gases which are different in mix ratio of the gases G$\mathbf{1}_t$ and G$\mathbf{2}_t$ may be four or less or six or more. The same applies to the on-site gas physical property correction formula database 35 (see FIGS. 7 and 9) described in the second and third embodiment.

Moreover, in the embodiments, description is given of the case where the two types of gases G$\mathbf{1}_t$ and G$\mathbf{2}_t$ are included in the test gas. However, the number of types of gases included in the test gas may be three or more. The test gas physical properties can be corrected by linear interpolation as in (formula 6) and (formula 7) also in this case.

The same applies to the on-site gas.

Furthermore, in the first embodiment, description is given of the configuration in which, when the molecular weight Mw of the test gas to be used in the prediction is not equal to any of the molecular weights stored in the test gas physical property correction formula database 32, the coefficients $Az_t$ and $Bz_t$ are obtained by the linear interpolation using (formula 6) and (formula 7). However, the configuration is not limited to this. Specifically, the configuration may be such that one of the test gases Mix$\mathbf{1}_t$ to Mix$\mathbf{5}_t$ which is stored in the test gas physical property correction formula database 32 and whose molecular weight is closest to the molecular weight of the test gas to be used in the prediction is selected and the compressibility factor $Z_t$ is calculated based on the correction formula for the selected test gas. Note that the same applies to the specific heat at constant volume $C_{vt}$ of the test gas, the compressibility factor $Z_{sp}$ of the on-site gas, and the specific heat at constant volume $Cv_{sp}$ of the on-site gas.

Moreover, in the first embodiment, description is given of the case where the pass/fail determination unit 33*d* determines whether the compressor 2 passes or fails the performance requirements, based on the processing results of the test parameter correction unit 33*b* and the on-site performance parameter calculation unit 33*c*. However, the present invention is not limited to this configuration. Specifically, the configuration may be such that the pass/fail determination unit 33*d* is omitted and the processing results of the test parameter correction unit 33*b* and the on-site performance parameter calculation unit 33*c* are displayed on the display device 4. In this case, the manager of the performance prediction device 3 can also grasp the numeric values of the test parameters and the on-site performance parameters and consider measures to be taken based on these numeric values. Note that the same applies to the second and third embodiments.

Furthermore, the configuration may be such that the pass/fail determination unit 33*d* and the on-site performance parameter calculation unit 33*c* are omitted from the first embodiment and the processing results of the test parameter correction unit 33*b* are displayed on the display device 4.

Moreover, in the second and third embodiments, description is given of the case where the on-site performance parameter calculation unit 33*c* calculates the discharge pressure (before correction) of the compressor 2 on the site. However, the configuration is not limited to this. For example, the on-site performance parameter calculation unit 33*c* may calculate both of the discharge pressure (before correction) and power (before correction) of the compressor 2.

Furthermore, in the embodiments, description is given of the case where the compressibility factor and the specific heat at constant volume of the test gas are used as the "test gas physical properties." However, for example, the Mach number of the test gas may also be included in the "test gas physical properties" (the same applies to the on-site gas).

Moreover, in the embodiments, description is given of the case where the polytropic head and the polytropic efficiency of the compressor 2 are calculated as the "test parameters." However, for example, a theoretical head of the compressor 2 may also be included in the "test parameters."

Furthermore, in the embodiments, description is given of the case where the discharge pressure and power of the compressor 2 on the site are calculated as the "on-site performance parameters." However, for example, a peripheral Mach number of the compressor (rotating speed of the compressor 2/Mach number) may also be included in the "on-site performance parameters."

Moreover, in the embodiments, description is given of the case where a linear function expressing a straight line is used as the test gas physical property correction formula (see FIGS. 3A and 3B). However, a certain function expressing a curve may be used. The same applies to the on-site gas physical property correction formula.

Furthermore, in the embodiments, description is given of the case where the compressor 2 is a single-shaft multi-stage centrifugal compressor. However, the compressor 2 is not limited to this. Specifically, the compressor 2 may be a mixed flow compressor or an axial flow compressor. Moreover, the compressor 2 may be a single-stage compressor.

Moreover, the embodiments are described in details to facilitate the understanding of the present invention and the present invention is not necessarily limited to a device including all of the described configurations.

Furthermore, all or part of the configurations, functions, processing units, processing means, and the like described above may be implemented by hardware by, for example, designing an integrated circuit. Moreover, the mechanism and configurations depicted herein are ones which are considered to be necessary for the description, and not all of the mechanism and configurations required in a product are necessarily depicted.

DESCRIPTION OF REFERENCE SIGNS

1: Test facility; 2: compressor; 3, 3A, 3B: performance prediction device; 31: actual measured data obtaining unit; 32: test gas physical property correction formula database; 33, 33A, 33B: computation processing unit; 33*a* test parameter calculation unit; 33*b*: test parameter correction unit; 33*c*: on-site performance parameter calculation unit; 33*d*, 33*f*: pass/fail determination unit; 33*e*: on-site performance parameter correction unit; 34: display control unit; 35: on-site gas physical property correction formula database; 36: test parameter obtaining unit; 4: display device.

What is claimed is:

1. A performance prediction device for a compressor, comprising:

an actual measured data obtaining unit that obtains actual measured data of a flow rate, an intake temperature, an intake pressure, a discharge temperature, and a discharge pressure of a compressor being a test target of a similitude test while the compressor is compressing a test gas including a plurality of types of gases;

a test gas physical property correction formula database that stores therein test gas physical property correction formulae each indicating a relationship of test gas physical properties, including a compressibility factor and a specific heat at constant volume, of the test gas actually used in the similitude test, with the test gas physical properties of a plurality of the test gases different in mix ratio of the gases, the test gas physical property correction formulae each being associated with the types and the mix ratios of the gases;

a test parameter calculation unit that calculates test parameters based on the actual measured data obtained by the actual measured data obtaining unit, the test parameters including a polytropic head and a polytropic efficiency which indicate performance of the compressor; and a test parameter correction unit that selects at least one of the test gas physical property correction formulae from the test gas physical property correction formula database based on the types and the mix ratio of the gases included in the test gas to be used in prediction of the performance of the compressor, and that corrects the test parameters by using the selected test gas physical property correction formula.

2. The performance prediction device for a compressor according to claim 1, wherein the test gas physical property correction formulae are stored in the test gas physical property correction formula database while being associated with the types, the mix ratios, and molecular weights of the gases, and the test parameter correction unit obtains a coefficient in the test gas physical property correction formula for the test gas to be used in the prediction, by performing linear interpolation based on a magnitude relationship of the molecular weight of the test gas to be used in the prediction with the molecular weights of the test gases stored in the test gas physical property correction formula database.

3. The performance prediction device for a compressor according to claim 1, further comprising an on-site performance parameter calculation unit that calculates on-site performance parameters including a discharge pressure and power which indicate the performance of the compressor on a site different from a test facility of the similitude test, based on the test parameters calculated by the test parameter calculation unit and an on-site operation condition at which to operate the compressor on the site.

4. The performance prediction device of a compressor according to claim 3, further comprising a pass/fail determination unit that determines that the compressor satisfies a requirement for the performance, when the test parameters corrected by the test parameter correction unit are within predetermined ranges and the on-site performance parameters calculated by the on-site performance parameter calculation unit are within predetermined ranges.

5. The performance prediction device for a compressor according to claim 3, further comprising:

an on-site gas physical property correction formula database that stores therein on-site gas physical property correction formulae each indicating a relationship of on-site gas physical properties, including the compressibility factor and the specific heat at constant volume, of an on-site gas which includes the plurality of types of gases and which is considered by the performance prediction device to be compressed by the compressor on the site, with the on-site gas physical properties of a plurality of on-site gases different in mix ratio of the gases, the on-site gas physical property correction formulae each being associated with the types and the mix ratios of the gases, an on-site performance parameter correction unit that selects at least one of the on-site gas physical property correction formulae from the on-site gas physical property correction formula database based on the types and the mix ratio of the gases included in the on-site gas to be actually compressed by the compressor on the site, and that corrects the on-site parameters by using the selected on-site gas physical property correction formula.

6. The performance prediction device for a compressor, according to claim 5, wherein the on-site gas physical property correction formulae are stored in the on-site gas physical property correction formula database while being associated with the types, the mix ratios, and molecular weights of the gases, and the on-site performance parameter correction unit obtains a coefficient in the on-site gas physical property correction formula for the on-site gas to be actually compressed by the compressor on the site, by performing linear interpolation based on a magnitude relationship of the molecular weight of the on-site gas to be actually compressed with the molecular weights of the on-site gases stored in the on-site gas physical property correction formula database.

7. The performance prediction device for a compressor according to claim 5, further comprising a pass/fail determination unit that determines that the compressor satisfies a requirement for the performance, when the test parameters corrected by the test parameter correction unit are within predetermined ranges and the on-site performance parameters corrected by the on-site performance parameter correction unit are within predetermined ranges.

8. A performance prediction device for a compressor, comprising:

a test parameter obtaining unit that obtains test parameters including a polytropic head and a polytropic efficiency which indicate performance of a compressor being a test target of a similitude test;

an on-site performance parameter calculation unit that calculates on-site performance parameters including a discharge pressure and power which indicate the performance of the compressor on a site different from a test facility of the similitude test, based on the test parameters obtained by the test parameter obtaining unit and an on-site operation condition at which to operate the compressor on the site;

an on-site gas physical property correction formula database that stores on-site gas physical property correction formulae each indicating a relationship of on-site gas physical properties, including a compressibility factor and a specific heat at constant volume, of an on-site gas which includes a plurality of types of gases and which is considered by the performance prediction device to be compressed by the compressor on the site, with the on-site gas physical properties of a plurality of on-site gases different in mix ratio of the gases, the on-site gas physical property correction formulae each being associated with the types and the mix ratios of the gases; and an on-site performance parameter correction unit that selects at least one of the on-site gas physical property correction formulae from the on-site gas physical property correction formula database based on the types and the mix ratio of the gases included in the on-site gas to be actually compressed by the compressor on the site, and that corrects the on-site parameters by using the selected on-site gas physical property correction formula.

9. The performance prediction device for a compressor according to claim 8, wherein the on-site gas physical property correction formulae are stored in the on-site gas physical property correction formula database while being associated with the types, the mix ratios, and molecular weights of the gases, and the on-site performance parameter correction unit obtains a coefficient in the on-site gas physical property correction formula for the on-site gas to be actually compressed by the compressor on the site, by performing linear interpolation based on a magnitude relationship of the molecular weight of the on-site gas to be actually compressed with the molecular weights of the on-site gases stored in the on-site gas physical property correction formula database.

10. The performance prediction device for a compressor according to claim 8, further comprising a pass/fail determination unit that determines that the compressor satisfies a requirement for the performance, when the on-site performance parameters corrected by the on-site performance parameter correction unit are within predetermined ranges.

* * * * *